US007784235B2

(12) United States Patent
Cretti

(10) Patent No.: US 7,784,235 B2
(45) Date of Patent: Aug. 31, 2010

(54) LOAD BEARING CONSTRUCTION ELEMENT, IN PARTICULAR FOR MANUFACTURING BUILDING FLOORS, AND FLOOR STRUCTURE INCORPORATING SUCH ELEMENT

(75) Inventor: Piero Cretti, Morbio Superiore (CH)

(73) Assignee: Plastedil S.A., Chiasso (CH)

( * ) Notice: Subject to any disclaimer, the term of this patent is extended or adjusted under 35 U.S.C. 154(b) by 900 days.

(21) Appl. No.: 11/125,089

(22) Filed: May 10, 2005

(65) Prior Publication Data

US 2006/0185280 A1 Aug. 24, 2006

(30) Foreign Application Priority Data

May 11, 2004 (IT) ..... MI2004A0941

(51) Int. Cl.
*E04B 1/19* (2006.01)
*E04C 1/00* (2006.01)

(52) U.S. Cl. ..... 52/332; 52/309.12; 52/649.1

(58) Field of Classification Search ..... 52/309.12, 52/332, 309.16, 309.17, 432, 309.7, 341, 52/414, 649.1, 649.2, 649.8, 309.8, 309.9, 52/334

See application file for complete search history.

(56) References Cited

U.S. PATENT DOCUMENTS 1,215,872 A * 2/1917 Salvatierra-Iriarte ..... 52/721.2
1,885,496 A * 11/1932 Venzie ..... 52/506.08
1,941,211 A * 12/1933 Inglee ..... 52/326
2,260,425 A * 10/1941 Widmayer ..... 52/324
2,997,812 A * 8/1961 Veillet ..... 52/649.1
3,104,600 A * 9/1963 White ..... 52/688
3,302,360 A * 2/1967 Bjerking ..... 52/600
3,347,007 A * 10/1967 Hale ..... 52/380
3,890,756 A * 6/1975 Wagner ..... 52/649.2
4,128,975 A * 12/1978 Abate ..... 52/125.4
4,157,640 A * 6/1979 Joannes ..... 52/309.7
4,272,230 A * 6/1981 Abate ..... 425/64
4,472,919 A * 9/1984 Nourse ..... 52/601
4,611,450 A * 9/1986 Chen ..... 52/309.4
4,614,013 A * 9/1986 Stevenson ..... 29/897.34
4,811,770 A * 3/1989 Rapp ..... 52/309.12

(Continued)

FOREIGN PATENT DOCUMENTS

DE 33 18 764 A1 4/1984

(Continued)

OTHER PUBLICATIONS

PCT—International Search Report dated Aug. 29, 2005.

(Continued)

*Primary Examiner*—Richard E Chilcot, Jr.
*Assistant Examiner*—Brent W Herring
(74) *Attorney, Agent, or Firm*—Sughrue Mion, PLLC

(57) ABSTRACT

A composite construction element (2) particularly useful for manufacturing building floors, comprises:

a) an elongated body (3) made of expanded plastic material, provided with at least one longitudinal channel (4) open on the upper side for receiving a concrete casting (5);

b) a reinforcement metal structure (11) of the casting (5), housed in the longitudinal channel (4), associated to the elongated body (3) and having opposite free ends (12) protruding from longitudinally opposite parts of the elongated body (3) for a portion of predetermined length.

Advantageously, the composite construction element (2) possesses optimum load bearing characteristics, lightness and flexibility of use.

44 Claims, 10 Drawing Sheets

U.S. PATENT DOCUMENTS

| | | | | | |
|---|---|---|---|---|---|
| 5,235,791 | A * | 8/1993 | Yaguchi | 52/649.1 |
| 5,398,470 | A * | 3/1995 | Ritter et al. | 52/309.11 |
| 5,448,866 | A * | 9/1995 | Saito et al. | 52/414 |
| 5,465,538 | A * | 11/1995 | Powers, Jr. | 52/204.2 |
| 5,501,055 | A * | 3/1996 | Storch et al. | 52/741.1 |
| 5,792,481 | A * | 8/1998 | Cretti | 425/4 C |
| 5,884,442 | A * | 3/1999 | Breault | 52/245 |
| 6,006,483 | A * | 12/1999 | Lee | 52/414 |
| 6,244,008 | B1 * | 6/2001 | Miller | 52/602 |
| 6,298,622 | B1 * | 10/2001 | Cretti | 52/309.7 |
| 6,305,135 | B1 * | 10/2001 | Inaba | 52/309.12 |
| 6,457,288 | B2 * | 10/2002 | Zambelli et al. | 52/220.2 |
| 6,955,014 | B2 * | 10/2005 | LeJeune et al. | 52/223.6 |
| 7,281,357 | B2 * | 10/2007 | Femminella | 52/334 |
| 2006/0137282 | A1 * | 6/2006 | Anvick et al. | 52/649.1 |
| 2008/0041004 | A1 * | 2/2008 | Gibbar et al. | 52/309.12 |

FOREIGN PATENT DOCUMENTS

| | | | |
|---|---|---|---|
| EP | 459924 | A1 * | 12/1991 |
| EP | 0 494 061 | A1 | 7/1992 |
| EP | 0 870 883 | A2 | 10/1998 |
| EP | 1 398 427 | A1 | 3/2004 |
| FR | 2 166 355 | A | 8/1973 |
| FR | 2 630 480 | A1 | 4/1988 |
| GB | 2 180 861 | A | 4/1987 |

OTHER PUBLICATIONS

PCT—Written Opinion dated May 10, 2005.

* cited by examiner

LOAD BEARING CONSTRUCTION ELEMENT, IN PARTICULAR FOR MANUFACTURING BUILDING FLOORS, AND FLOOR STRUCTURE INCORPORATING SUCH ELEMENT

BACKGROUND OF THE INVENTION

In a general aspect thereof, the present invention relates to a construction element provided with load bearing characteristics, which finds a preferred—although not exclusive—use in the construction of floors for buildings in general.

In the following description and in the appended claims, the term: load bearing construction element, is used to indicate an element having mechanical characteristics capable to withstand without structural yielding both the stresses undergone during transport and installation, and the concrete casting weight.

In the following description and in the appended claims, the term: floor, is used to indicate both a horizontal structure adapted to support the floor of each storey of a building (including the floor directly above the ground), and a horizontal or slanting covering structure adapted to close at the top the last storey of the building itself.

PRIOR ART

As is known, it has long become widespread, in the field of the building industry in general, the use of construction elements made of expanded plastic material, preferably foamed polystyrene, in the form of-slabs or section bars of suitable shape and size and having the function of heat and sound insulating material.

It is also known that in order to impart suitable load bearing characteristics to such construction elements it is necessary to incorporate one or more suitably shaped reinforcing section bars in the mass of expanded plastic material.

Thus, for example, European Patent EP 0 459 924 discloses a load bearing construction element made of expanded plastic material, in particular a floor element, comprising a central body, substantially parallelepipedic, inside which a reinforcing section bar consisting of an I-shaped thin sheet is integrated during the forming operations.

If on the one side, the construction elements of this kind exhibit characteristics of lightness and low cost, their spreading in the field and their flexibility of use have been hindered so far by the limited load bearing characteristics of the construction elements of known type.

In order to manufacture floors having a certain length, and particularly those longer than about 1.5 meters, in fact, it is necessary to arrange suitable supporting elements spaced from each other in a convenient manner under the floor structure being constructed with the construction elements, the so-called "temporary supports", with an undesirable increase of labor and of the costs for manufacturing the floor.

SUMMARY OF THE INVENTION

The object of the present invention is to provide a composite construction element for manufacturing floors for buildings in general, provided with improved load bearing characteristics which would allow a substantial reduction of labor and costs for manufacturing the floor.

According to the invention, this object is achieved by a composite construction element comprising:

a) an elongated body made of expanded plastic material, provided with at least one longitudinal channel open on an upper side for receiving a concrete casting;

b) a reinforcement metal structure of the casting housed in said at least one longitudinal channel, said reinforcement metal structure being associated to said elongated body and having opposite free ends protruding from longitudinally opposite sides of said elongated body.

In the following description and in the appended claims, the term: composite construction element, is used to indicate an element comprising an elongated body made of expanded plastic material, for example of foamed polystyrene, and a reinforcement metal structure associated to the elongated body itself.

Advantageously, the composite construction element of the invention comprises both a structure adapted to impart suitable load bearing characteristics—i.e. the reinforcement metal structure of the concrete casting—and a structure for containing the casting—i.e. the elongated body made of expanded plastic material provided with at least one longitudinal channel open on the upper side—which structures are usually obtained by assembling at the building yard elements which are structurally separate from one another (variably shaped bodies made of expanded plastic material with suitable reinforcing rods arranged therebetween).

The composite construction element of the invention, moreover, is also capable of achieving with respect to the construction elements of the prior art both improved load bearing characteristics, imparted thereto by the reinforcement metal structure, and suitable lightness and easy-to-handle features, imparted thereto by the elongated body made of expanded plastic material.

More particularly, the aforementioned reinforcement metal structure allows to lay the composite construction element on the supporting structures of the building being erected, such as for example load bearing beams or walls, by means of its free ends protruding from longitudinally opposite sides of the elongated body made of expanded plastic material.

In this way, the composite construction element is supported by the reinforcement metal structure rather than by the elongated body made of expanded plastic material which is preferably hung to the reinforcement metal structure without laying on any of the load bearing structures of the building being erected.

Advantageously, the composite construction element allows in this way to do without the temporary supports or to use them only for floor lengths of more than about 3 meters, with a considerable simplification of the operations for assembling the floor and with an advantageous reduction of time and costs for manufacturing the same.

In other words, the composite construction element of the invention allows to double the floor length that needs no temporary supports with respect to the construction elements of the prior art.

Advantageously, the manufacture of a floor structure by means of the composite construction elements of the invention can be carried out by simply laying the latter—already assembled at the factory or at the building yard—on the load bearing structures of the building being erected. Thanks to the aforementioned structural features of the composite construction elements, this operation can be carried out with the utmost reduction or even without using fixed or mobile scaffolds, which are almost invariably needed to install the construction elements of the prior art.

Advantageously, the free ends of the reinforcement metal structure of the casting housed in the aforementioned at least one longitudinal channel protrude from longitudinally opposite parts of the elongated body made of expanded plastic material for a portion of predetermined length, preferably comprised between about 50 mm and about 200 mm and still more preferably, comprised between about 100 mm and about 150 mm.

For the purposes of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

In a preferred embodiment, the reinforcement metal structure of the casting housed in the aforementioned at least one longitudinal channel and the elongated body made of expanded plastic material are rigidly associated to one another so as to form a composite construction element provided with suitable characteristics of stiffness and of resistance to the various stresses which the element is subjected to, both during transport to the yard and during installation.

To this end, the reinforcement metal structure is preferably provided with hooking means adapted to cooperate with respective engagement elements defined in the elongated body made of expanded plastic material.

In a first preferred embodiment of the invention, the aforementioned hooking means comprises a plurality of hooking portions extending from a lower side of the reinforcement metal structure.

Preferably, these hooking portions are provided with a portion extending substantially parallel to the longitudinal axis of the reinforcement metal structure, so as -to define respective receiving zones wherein it is possible to fit, with a substantially bayonet-like coupling, the engagement elements defined in the elongated, body made of expanded plastic material.

Within the framework of this preferred embodiment, the engagement elements defined in the elongated body made of expanded plastic material comprise a plurality of transversal bars extending through the aforementioned at least one longitudinal channel along a direction substantially perpendicular to the longitudinal axis of the elongated body made of expanded plastic material.

Preferably, these transversal bars are constituted by metal rods having a diameter slightly smaller than the height of the receiving zones defined by the hooking portions extending from the lower side of the reinforcement metal structure, so as to allow an easy introduction of the transversal bars into the aforementioned zones.

In a preferred embodiment, these transversal bars are provided with opposite ends fixed to respective reinforcing bars longitudinally extending in the elongated body at opposite parts of the aforementioned longitudinal channel along a direction substantially parallel to the longitudinal axis of the elongated body itself.

In this way, the transversal bars and the longitudinal reinforcing bars advantageously form a substantially ladder-shaped reinforcing framework, adapted to further stiffen the elongated body made of expanded plastic material.

Still within the framework of this preferred embodiment of the hooking elements and of the engagement elements cooperating with the former, the hooking portions extending from the lower side of the reinforcement metal structure and the transversal bars extending through the longitudinal channel are pitchwise arranged along a direction substantially parallel to the longitudinal axis of the construction element.

Preferably, the pitch of the hooking portions and of the transversal bars is comprised between about 150 mm and about 300 mm and, still more preferably, comprised between about 180 and about 220 mm.

In a preferred embodiment, the reinforcement metal structure is substantially constituted by a trestle comprising a pair of lower longitudinal rods connected to at least one upper longitudinal rod by a plurality of lateral stiffening elements, preferably metal rods.

In this way, the reinforcement metal structure exhibits advantageous characteristics of lightness and structural simplicity even though it is capable of ensuring an adequate resistance to the longitudinal compression stresses, exerted by the upper rod, and to the longitudinal tensile stresses, exerted by the lower rods.

Within the framework of this preferred embodiment of the reinforcement metal structure, the lateral stiffening rods can be shaped substantially as an upturned V and can be arranged in pairs along a direction substantially parallel to the longitudinal axis of the reinforcement metal structure.

In this way, it is possible to achieve adequate stiffness characteristics of the reinforcement metal structure with structurally simple and low weight elements (the lateral rods).

In this preferred embodiment, the lateral stiffening rods are preferably advantageously provided with a free end extending from the lower side of the reinforcement metal structure and adapted to define the hooking portion of the reinforcement metal structure adapted to cooperate with the engagement elements defined in the elongated body made of expanded plastic material.

In this way, it is possible to form structurally simple hooking means of the aforementioned engagement elements.

In a preferred embodiment, the transversal bars integral with the elongated body made of expanded plastic material are provided on the upper side with longitudinal abutment elements arranged at opposite parts of the lower longitudinal rods of the reinforcement metal structure.

Advantageously, these longitudinal abutment elements constitute as many abutment means adapted to cooperate in abutment relationship with the aforementioned rods so as to prevent that the trestle-shaped reinforcement metal structure thus defined may be opened along a transversal direction under the load of the concrete casting or under the action of other stresses directed perpendicularly to the structure itself.

In a preferred alternative embodiment of the invention, the trestle-shaped reinforcement metal structure is provided with a plurality of transversal stiffening elements, preferably metal rods, extending between the lateral stiffening rods to which they are fixed, for example by welding.

These transversal stiffening elements, which are preferably extending along a direction substantially perpendicular to the longitudinal axis of the reinforcement metal structure, make the latter substantially of the cage-like type, and form as many means adapted to prevent that the substantially cage-like structure thus defined may be opened under the load of the concrete casting or under the action of other stresses directed perpendicularly to the structure itself.

In an alternative preferred embodiment of the invention, the aforementioned hooking means comprises a plurality of hooking portions laterally extending at opposite parts of the reinforcement metal structure.

Within the framework of this preferred embodiment, the engagement elements defined in the elongated body made of expanded plastic material cooperating with the hooking means comprise a pair of longitudinal grooves formed in the elongated body made of expanded plastic material at opposite parts of the aforementioned at least one longitudinal channel.

In this way, the elongated body made of expanded plastic material and the reinforcement metal structure can be rigidly associated to each other by sliding in a drawer-wise manner the body with respect to the reinforcement metal structure thanks to the sliding engagement between the hooking portions of the latter and the aforementioned longitudinal grooves.

In this preferred embodiment, therefore, the longitudinal grooves define respective receiving and sliding zones of the hooking portions and are thus preferably shaped so as to have a cross section substantially mating the cross section of the hooking portions.

Preferably, the composite construction element further comprises a slab-shaped reinforcing element adapted to reinforce at least an upper wall of the aforementioned longitudinal grooves and longitudinally extending in the elongated body made of expanded plastic material substantially parallel to the aforementioned upper wall.

In this way, it is advantageously possible to prevent that the hooking portions defined in the reinforcement metal structure may damage the elongated body made of expanded plastic material, when the latter is subjected to stresses directed perpendicularly to the elongated body itself.

In an alternative preferred embodiment and still in order to prevent damages to the elongated body made of expanded plastic material, the composite construction element can comprise a pair of supporting section bars fixed on the upper side of the hooking portions of the reinforcement metal structure and cooperating in abutment relationship with the upper wall of the longitudinal grooves formed in the elongated body made of expanded plastic material.

In this case, the upper wall of the longitudinal grooves and the supporting section bars preferably have a substantially mating shape so as to minimize any possible reciprocal movements during the installation operations.

Within the framework of this preferred embodiment and if the reinforcement metal structure is of the trestle type, the lateral stiffening elements are preferably constituted by metal rods provided with a plurality of portions substantially shaped as an upturned V and extending along a direction substantially parallel to the longitudinal axis of the reinforcement metal structure itself.

In this case, the hooking portions of the reinforcement metal structure are preferably constituted by respective loop portions extending in a cantilevered fashion from said structure between the aforementioned substantially V-shaped portions.

Advantageously, this configuration allows to have a structural continuity of the lateral stiffening rods which simplifies the manufacturing operations of the trestle.

In an alternative preferred embodiment, the hooking portions laterally extending from the reinforcement metal structure can be constituted by respective end portions of a plurality of stiffening staples shaped as an upturned V.

According to this preferred configuration, the stiffening staples are structurally independent from one another and are fixed, for example by welding, to the upper longitudinal rod of the reinforcement metal structure so that their end portions are laterally extending in a cantilevered fashion from the trestle-shaped reinforcement metal structure at opposite parts thereof.

In a preferred embodiment of the invention, the composite construction element further comprises at least one reinforcing section bar associated to the elongated body made of expanded plastic material and having a lower portion extending substantially parallel to a lower face of the elongated body made of expanded plastic material.

In this way, it is advantageously possible both to achieve improved characteristics of structural stiffness of the elongated body made of expanded plastic material, and to have means adapted to allow the fixing of suitable covering elements of the lower face of the construction element, described hereinafter, with suitable fixing means, such as for example screws or bolts.

For the purposes of the invention, the aforementioned at least one reinforcing section bar can be both externally associated to the elongated body made of expanded plastic material and longitudinally extending inside the same, for example embedded into this body when molding the expanded plastic material.

In a first preferred embodiment, the lower portion of the aforementioned at least one reinforcing section bar is extending substantially flush with the lower face of the elongated body made of expanded plastic material.

In this way, it is advantageously possible to have an easy access to the lower portion of the reinforcing section bar forming the aforementioned means adapted to allow the fixing of suitable covering elements of the lower face of the construction element, which lower portion is visible during the fixing of the covering elements.

In an alternative preferred embodiment, the lower portion of the aforementioned at least one reinforcing section bar is completely incorporated in the elongated body made of expanded plastic material. In this case, the lower portion of the at least one reinforcing section bar extends substantially parallel to the lower face of the aforementioned body at a distance preferably comprised between about 5 mm and about 15 mm from said face.

In this way, it is possible to fix suitable covering elements of the lower face of the construction element to the lower portion of the aforementioned at least one reinforcing section bar using fixing elements of limited length.

Since the lower portion of the reinforcing section bar is not visible under the composite construction element, in order to fix the covering elements it is necessary in this case to know in advance the position of such portion inside the mass of expanded plastic material with respect to any reference element, such as for example with respect to the sides or with respect to the longitudinal center plane of the elongated body made of expanded plastic material.

In a particularly preferred embodiment, the aforementioned at least one reinforcing section bar is securely associated to the reinforcement metal structure of the concrete casting.

In this way, the composite construction element advantageously achieves improved fire resistance characteristics since the covering elements of the lower face of the construction element are securely held by the reinforcement metal structure embedded in the concrete casting by means of the reinforcing section bar, and in case of fire, they do not detach from the construction element even in the presence of a complete collapse of the elongated body made of expanded plastic material.

Preferably, the aforementioned at least one reinforcing section bar is suitably shaped and is made of a material having adequate structural characteristics, for example cold-rolled and preferably galvanized steel, rigid plastic materials such as PVC, polyester polymers, polycarbonate, acrylonitrile-butadiene-styrene (ABS) copolymers and the like.

For obvious reasons of construction simplicity and to limit the production costs, the reinforcing section bar is preferably shaped as a C, Z or I.

According to a preferred embodiment of the invention, the reinforcing section bar longitudinally extends in the elongated body of the construction element along substantially the entire length thereof.

Preferably, the reinforcing section bar is provided with a central body and with one or two fins respectively extending from the lower end or from the opposite ends of the central body of the section bar.

In this preferred embodiment, the lower portion of the reinforcing section bar(s) extending substantially parallel to the lower face of the elongated body made of expanded plastic material and having the function of providing a suitable supporting surface to which a suitable covering element can be fixed, is therefore constituted by the aforementioned lower fin.

As described hereinbefore, such fin can either be extending substantially flush with the lower face of the elongated body made of expanded plastic material or be completely incorporated in the mass of expanded plastic material and arranged at a predetermined distance from said lower face.

Preferably, the composite construction element comprises a pair of reinforcing section bars longitudinally extending in the elongated body at opposite sides of the aforementioned at least one longitudinal channel along a direction substantially parallel to the longitudinal axis of the aforementioned body.

Thanks to this arrangement of the reinforcing section bars, it is advantageously possible to achieve even reinforcement characteristics of the elongated body at opposite sides of the longitudinal channel. Preferably, the reinforcing section bars are symmetrically arranged in the elongated body with respect to a longitudinal center plane thereof so as to achieve a balanced and symmetrical reinforcing action.

In this preferred embodiment, the reinforcing section bars of the aforementioned pair are preferably spaced from one another at a predetermined distance.

In this way, it is advantageously possible to distribute in a suitable manner the reinforcing section bars inside the elongated body made of expanded plastic material, thus achieving some advantageous technical effects possibility of homogeneously distributing the reinforcing action exerted by the same; possibility of homogeneously distributing the loads applied to the reinforcing section bars (essentially the weight of the covering elements fixed to their lower portion) and, finally, possibility of arranging in a known and reproducible manner the lower portion of the reinforcing section bars so as to know their position even when such lower portion is completely embedded in the mass of expanded plastic material and as such, not visible from the outside.

Preferably, the distance between the center of the lower portion of the reinforcing section bars—measured along a direction substantially perpendicular to the longitudinal axis of the elongated body made of expanded plastic material—is comprised between about 250 mm and about 350 mm and, still more preferably, it is equal to about 300 mm.

Portions of predetermined length of the reinforcing section bar can be obtained by conventional bending and shearing operations, known per se, starting from a metal sheet having a height comprised between about 100 mm and about 300 mm and, still more preferably, comprised between about 120 mm and about 250 mm and a thickness comprised between about 0.4 mm and about 1.2 mm and, still more preferably, comprised between about 0.5 mm and about 0.8 mm.

Preferably, the central portion of the reinforcing section bar has, after bending, a height comprised between about 60 mm and about 285 mm, whereas the fin(s) of the section bar has/have a length comprised between about 15 mm and about 40 mm and, still more preferably, comprised between about 20 mm and about 30 mm.

Preferably, moreover, the reinforcing section bar(s) is(are) advantageously provided with a plurality of openings formed in the central portion thereof, outside or comprised between the aforementioned fins.

Such openings carry out the dual advantageous function of lightening the reinforcing section bar and of allowing a more intimate integration thereof in the mass of expanded plastic material.

Thanks to the presence of such openings, in fact, the mass of expanded plastic material is capable of interpenetrating with the reinforcing section bar during the forming operation, integrating and firmly holding in position the reinforcing section bar within the elongated body of the construction element.

This intimate integration of the reinforcing section bar in the mass of expanded plastic material, moreover, prevents any deformation or bending along the transversal direction of the reinforcing section bar even though the reinforcing section bar is essentially constituted, as mentioned hereinbefore, by a fairly thin metal sheet.

Preferably, the aforementioned openings have a total area comprised between about 10% and about 40% of the total area of the reinforcing section bar, where the expression total area of the reinforcing section bar refers to the area of the whole lateral surface of the section bar including the area of its fin(s) (that is, the area of the total lateral surface before forming the fins and the openings).

Still more preferably, the openings formed in the central portion of the reinforcing section bar have an overall area comprised between about 20% and about 30% of the total area of the reinforcing section bar.

According to the invention, the shape of the openings—obtainable in a way known per se, such as for example by punching—is not critical; in any case, such a shape is preferably circular for obvious reasons of construction simplicity.

In this case, the openings have a diameter preferably comprised between about 15 mm and about 100 mm and, more preferably, comprised between about 40 and about 70 mm.

In a preferred embodiment, the openings are pitchwise arranged in the central portion of the reinforcing section bar along the center plane of the section bar itself.

Preferably, the pitch of the openings is comprised between about 80 and about 100 mm.

In an alternative preferred embodiment of the invention, the reinforcing section bars are substantially C shaped, and are externally associated to a lower portion of opposite sides of the elongated body made of expanded plastic material.

In this way, it is possible—if desired—to place the reinforcing section bars after forming the elongated body made of expanded plastic material, an operation which can be carried out with a less complex and less expensive equipment, in order to meet specific and contingent application requirements.

In a preferred embodiment, the reinforcing section bar(s) is(are) securely associated to the reinforcement metal structure by means of the transversal bars extending through the longitudinal channel formed in the elongated body made of expanded plastic material.

In this case, such bars are provided with opposite ends fixed to an upper portion—for example to a suitably shaped upper fin—of the reinforcing section bar(s).

In an alternative preferred embodiment, the reinforcing section bar(s) is(are) securely associated, for example welded, to the reinforcement metal structure at the hooking portions laterally extending at opposite parts thereof.

In a further preferred embodiment, the reinforcing section bars are provided with an upper fin extending flush with and substantially parallel to, the upper wall of the longitudinal grooves formed in the elongated body made of expanded plastic material.

In this way, this fin forms the aforementioned slab-shaped reinforcing element of the wall adapted to prevent possible damages to the elongated body made of expanded plastic material.

In a preferred embodiment, the composite construction element further comprises a lath for supporting at least one layer made of a suitable covering material associated to a lower face of the elongated body made of expanded plastic material.

In the following description and in the subsequent claims, the terms: lath for supporting at least one covering layer, are used to indicate not only conventional laths having a mesh structure—either smooth or provided with protruding ribs—obtained by stretching a suitably notched metal sheet, but also any sheet-like member adapted to support a suitable covering material.

Preferably, the lath for supporting at least one covering layer is a stretched metal lath essentially formed by a rhomb-shaped mesh having a length-to-height rhomb ratio of 2:1.

Preferably, the rhomb length varies between about 20 and about 60 mm, while the rhomb width varies between about 10 and about 30 mm.

Preferably, furthermore, such a stretched lath has a thickness comprised between about 0.4 mm and about 1.0 mm and, still more preferably, comprised between about 0.4 mm and about 0.8 mm.

Preferably, the lath comprises opposite lateral portions housed in respective longitudinal housing seats formed in opposite sides of the elongated body made of expanded plastic material.

In this way, the lath can be firmly held by the elongated body made of expanded plastic material by simply crimping its lateral portions into the aforementioned longitudinal seats.

In order to increase as much as possible the fire resistance characteristics of the construction element, the material of the covering layer associated to the lath is preferably selected from plaster, cement, or other material having fire-retardant and fire resistance properties, such as for example combinations of cement with reinforcing fibers of a suitable material.

In a preferred embodiment, the lath is associated to the lower portion, for example to a lower fin, of the aforementioned at least one reinforcing section bar.

In this way, it is advantageously possible to increase the holding capacity of the lath by the construction element and, if the reinforcing section bar is securely associated to the reinforcement metal structure, also the fire resistance characteristics of the construction element itself.

In an alternative preferred embodiment, the covering element of the composite construction element can be a rigid covering element associated to a lower face of the elongated body made of expanded plastic material.

Preferably, this rigid covering element is associated to the lower portion, for example to a fin, of the aforementioned at least one reinforcing section bar.

In this way, it is advantageously possible to increase the capacity of the construction element of holding the rigid covering element and, if the reinforcing section bar is securely associated to the reinforcement metal structure, also the fire resistance characteristics of the construction element itself.

Preferably, such a covering element is a panel of plasterboard, wood, rigid plastic material or other suitable material having an ornamental and/or a structural function.

In a further preferred embodiment of the invention, the composite construction element can further comprise at least one transversal channel formed in the elongated body made of expanded plastic material and open on the upper side for receiving a concrete casting and an additional reinforcement metal structure of the casting housed in the aforementioned transversal channel.

In this way, it is advantageously possible to increase the load bearing characteristics of the floor structure obtainable by composite construction elements thus realized, also decreasing the number of supporting beams or reducing, with the same load bearing characteristics, the overall thickness of the floor structure.

A composite construction element realized in this way, moreover, achieves advantageous features of flexibility which allow its use in the most varied applications.

In a preferred embodiment, the reinforcement metal structure of the casting is provided with a supporting plate at its free ends protruding from the elongated body made of expanded plastic material.

This plate carries out a plurality of advantageous functions.

A first function is that of allowing a safe and secure laying of the reinforcement metal structure protruding from the elongated body made of expanded plastic material on the supporting structures, for example walls or beams, of the building being erected.

A second function, useful when the reinforcement metal structure is of the trestle type, is that of closing at the ends the reinforcement metal structure and of holding in place both the lower longitudinal rods and the upper longitudinal rod of the structure, rods that in this case are fixed to the plate itself, for example by welding.

In this way, it is possible to prevent that the trestle-shaped reinforcement metal structure may open under the load of the concrete casting even without special longitudinal abutment elements.

According to a preferred feature of the invention, moreover, the free ends of the reinforcement metal structure and—if present—the plates associated thereto, protrude from the elongated body made of expanded plastic material at a predetermined distance from the lower face of the aforementioned body.

Preferably, such a distance is comprised between about 40 mm and about 80 mm.

This configuration allows to obtain a plurality of advantages.

A first advantage is related to the fact that it is possible in this way to adjust the heat and sound insulation characteristics of the composite construction element by adjusting the thickness of the portion of the elongated body made of expanded plastic material extending below the longitudinal channel wherein the reinforcement metal structure is housed.

A second important advantage is related to the fact that it is possible in this way to have a composite construction element that, once laid on a so-called whole-thickness truss beam, allows to obtain a covering extending perfectly flush with the entire lower face of the floor structure.

The lower face of the elongated body made of expanded plastic material in fact lies in a plane which is located below the lower face of the bare whole-thickness truss beam, that is, without covering.

In this way, it is therefore possible to coat the lower face of the whole-thickness truss beam with a slab made of expanded plastic material of suitable thickness to have the aforementioned advantageous effect of a covering extending perfectly flush with the entire lower portion of the floor structure, beams included, even for length spans exceeding 6 meters.

Advantageously, moreover, the thickness of this covering can be adjusted as desired by simply adjusting the thickness of the portion of the elongated body made of expanded plastic material extending below the longitudinal channel in which the reinforcement metal structure is housed.

According to a further aspect thereof, the present invention also relates to a floor structure comprising a plurality of composite construction elements of the type described above, laying at their opposite ends on respective supporting structures of a building, such as for example load bearing walls or beams.

In a preferred embodiment, the composite construction elements are arranged in side by side relationship in the floor structure, that is, they form per se floor elements.

In an alternative preferred embodiment, the floor structure may comprise construction elements made of expanded plastic material of the conventional type placed between composite construction elements according to the invention.

In other words, the composite construction elements of the invention are alternately arranged with conventional construction elements made of expanded plastic material and form as many joists on which the conventional construction elements made of expanded plastic material, which form as many floor elements, are laying.

In this case, it is advantageously possible to assemble floor structures adapted to meet the most varied insulation requirements in a very flexible manner, using the composite construction elements of the invention as standard support joists and adjusting the height of the conventional floor elements made of expanded plastic material.

In a preferred embodiment, at least one of the supporting structures of the composite construction elements according to the invention is a so-called "whole-thickness truss beam", that is, a truss beam having a thickness substantially equal to the thickness of the floor structure.

Within the framework of this preferred embodiment, the whole-thickness truss beam is preferably provided at a lower side with a covering slab made of expanded plastic material.

Still more preferably, the thickness of the covering slab of the truss beam is substantially equal to the distance between the free ends of the reinforcement metal structures-and the lower face of the elongated body made of expanded plastic material of the composite construction elements, so as to have—as mentioned above—a covering extending perfectly flush with the entire lower portion of the floor structure, truss beams included.

BRIEF DESCRIPTION OF THE DRAWINGS

Additional features and advantages of the invention will become more clearly apparent from the description of some preferred embodiments of a composite construction element and of a floor structure according to the invention, made hereinafter by way of a non-limiting example with reference to the annexed drawings.

In the drawings.

DETAILED DESCRIPTION OF THE PREFERRED EMBODIMENTS

Figure 1:
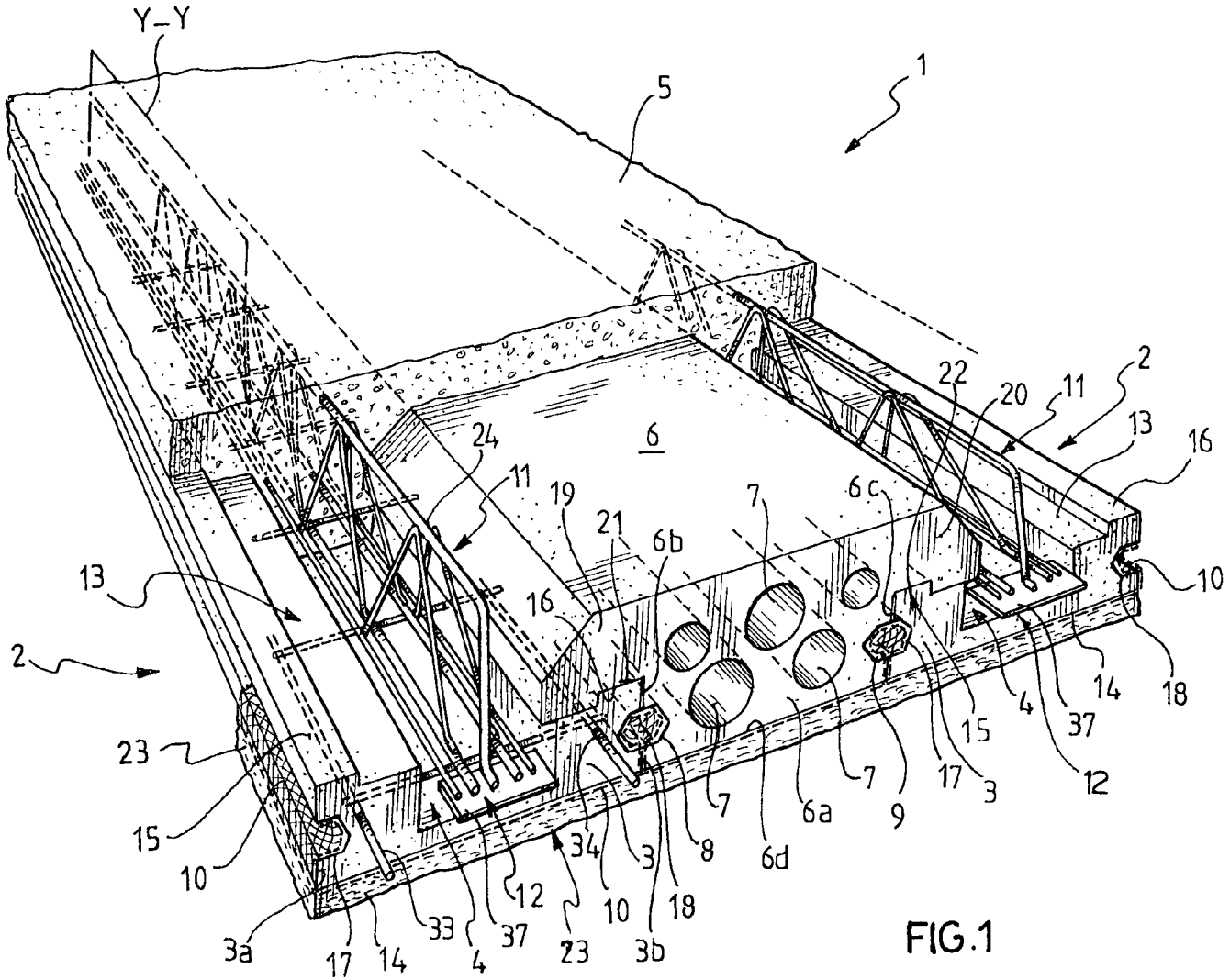
FIG. 1 shows a perspective view, in partial cross-section, of some details of a floor structure incorporating a plurality of composite construction elements according to a first preferred embodiment of the invention.
Figure 2A:
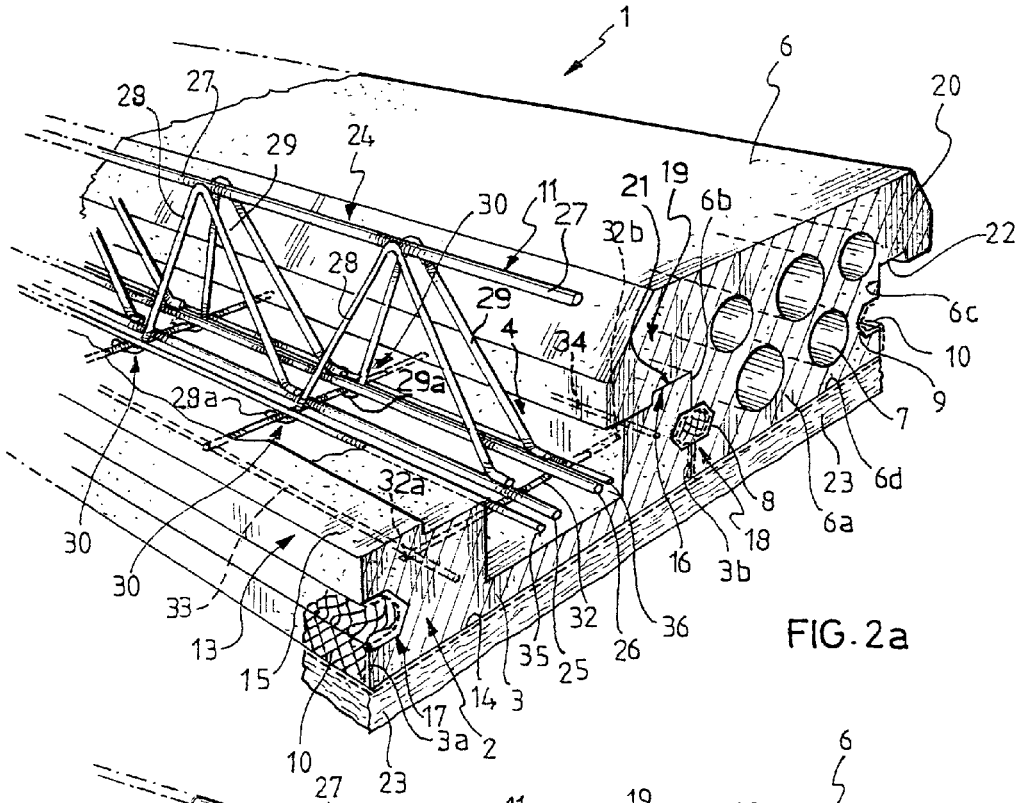
FIG. 2*a* shows a perspective view, in enlarged scale and in partial cross-section, of some details of the floor structure and of one of the composite construction elements of FIG. 1.

With reference to FIGS. 1 and 2*a*, a floor structure comprising a plurality of composite construction elements 2 according to a first preferred embodiment of the invention, arranged between construction elements 6 made of expanded plastic material of conventional type, is generally indicated at 1.

In this preferred embodiment of the floor structure 1, the composite construction elements 2, arranged in alternation with the conventional construction elements 6, form as many joists on which the construction elements 6, which form as many floor elements, are laid.

Each composite construction element 2 comprises an elongated body 3 made of expanded plastic material, for example of expanded polystyrene, provided with at least one longitudinal channel 4 open on the upper side for housing a concrete casting 5.

Each of the composite construction elements 2 also comprises -a metal structure 11 for reinforcing the casting 5 housed in the longitudinal channel 4 and associated to the elongated body 3, preferably in a rigid manner.

The reinforcement metal structure 11—which will be described in more detail hereinafter—is provided in turn with opposite free ends—only one of which, indicated with reference numeral 12, is visible in FIG. 1—protruding from longitudinally opposite sides of the elongated body 3.

Preferably, the free ends 12 of the reinforcement metal structure 11 form as many free ends of the composite construction elements 2 protruding from longitudinally opposite sides of the elongated body 3 for a portion of predetermined length, for example comprised between about 100 mm and about 150 mm.

In this preferred embodiment, the elongated body 3 is substantially parallelepipedic in shape and is provided with a suitably shaped upper face 13 and with an essentially planar lower face 14.

Preferably, the longitudinal channel 4 is formed at the upper face 13 of the elongated body 3 and extends astride of a longitudinal center plane Y-Y of the composite construction element 2.

In this preferred embodiment, the longitudinal center plane Y-Y of the composite construction element 2 coincides with the longitudinal center plane of the elongated body 3 and of the reinforcement metal structure 11 and also defines the longitudinal axes of these components.

In this preferred embodiment, the elongated body 3 is provided on the upper side with a pair of longitudinal projections 15, 16 extending from laterally opposite parts of the upper face 13 and adapted to cooperate joint-wise with the floor elements 6, as will be better described hereinafter.

The elongated body 3 of each composite construction element 2 is further laterally provided with suitably shaped opposite sides 3*a*, 3*b* in which respective longitudinal grooves 17, 18, defining as many longitudinal housing seats adapted to house respective side portions of a lath 10 for supporting at least one layer 23 made of a suitable covering material, are formed.

In this way, the lath 10 can be firmly held by the elongated body 3 by simply crimping its lateral portions into the aforementioned longitudinal seats 17, 18 as better illustrated in FIG. 2*a*.

Preferably, the lath 10 is a stretched metal lath made of a rhomb-shaped mesh and having a thickness comprised, for example, between about 0.4 mm and about 0.8 mm.

In order to increase as much as possible the fire resistance characteristics of the construction element, the material of the covering layer associated to the lath is preferably selected from plaster, cement, or other material having fire-retardant and fire resistance properties such as, for example, combinations of cement with reinforcing fibers of suitable material.

In the illustrated example, each of the floor elements 6 comprises a substantially T-shaped central body 6*a*, wherein a plurality of parallel recesses 7 is longitudinally defined.

Each floor element 6 is also laterally provided with suitably shaped opposite sides 6*b*, 6*c* in which respective longitudinal grooves 8, 9, defining as many longitudinal housing seats adapted to house respective lateral portions of a lath 10 similar to the lath associated to the lower face 14 of the composite construction elements 2, are formed.

The floor element 6 is also provided on the upper side with a pair of protruding portions 19, 20 laterally and longitudinally extending at opposite parts of the central body 6*a*.

Advantageously, the protruding portions 19, 20 of the central body 6*a* are provided at a lower side with respective longitudinal grooves 21, 22 having a shape mating the shape of the longitudinal projections 16 and, respectively, 15, of the elongated body 3. In this way, a plurality of floor elements 6 can be securely connected to the composite construction elements 2 with a substantially joint-wise coupling, as illustrated in FIGS. 1 and 2*a*.

In this preferred embodiment, therefore, each composite construction element 2 and each floor element 6 further comprises a lath 10 associated to a lower face 14, 6*d* of the elongated body 3 and, respectively, of the central body 6*a* made of expanded plastic material.

In the preferred embodiment illustrated, the reinforcement metal structure 11 is substantially constituted by a trestle 24 comprising a pair of lower longitudinal rods 25, 26 connected to at least one upper longitudinal rod 27 by means of a plurality of lateral stiffening elements 28, 29, in this case constituted by metal rods.

Preferably, the lateral stiffening rods 28, 29 are substantially shaped as an upturned V and are arranged in pairs along a direction substantially parallel to the longitudinal axis of the reinforcement metal structure 11 at opposite parts of the upper longitudinal rod 27.

More particularly, the lateral stiffening rods 28, 29 are fixed, for example by welding, at opposite parts of the upper longitudinal rod 27 at the vertex of each of the aforementioned V.

The lateral stiffening rods 28, 29 are also fixed, for example by welding, to the lower longitudinal rods 25, 26 at the end portions thereof.

The reinforcement metal structure 11 is preferably provided with hooking means adapted to cooperate with respective engagement elements 31 defined in the elongated body 3 for associating the reinforcement metal structure 11 and the elongated body 3 to one another.

Preferably, this hooking means comprises a plurality of hooking portions 30 extending from a lower side of the reinforcement metal structure 11, as better illustrated in FIG. 2*a*.

In the preferred embodiment illustrated in this figure, the hooking portions 30 are essentially constituted by a suitably shaped free end 28*a*, 29*a* of the lateral stiffening rods 28, 29 extending from the lower side of the reinforcement metal structure 11.

Preferably, the hooking portions 30 defined by these free ends 28*a*, 29*a* of the lateral stiffening rods 28, 29 are provided with a portion extending substantially parallel to the longitudinal axis of the reinforcement metal structure 11 and formed by the end part of each free end 28*a*, 29*a*.

In this way, it is advantageously possible to ensure a secure engagement of the engagement elements 31 in the hooking portions 30, as will better appear hereinafter.

In the preferred embodiment illustrated in FIGS. 1 and 2*a*, the engagement elements 31 defined in the elongated body 3 comprise a plurality of transversal bars 32, for example metal rods having a circular section, extending through the longitudinal channel 4 along a direction substantially perpendicular to the longitudinal axis of the elongated body 3 made of expanded plastic material.

Preferably, the transversal bars 32 are provided with opposite ends 32*a*, 32*b* fixed to respective reinforcing bars 33, 34 longitudinally extending in the elongated body 3 at opposite parts of the longitudinal channel 4 along a direction substantially parallel to the longitudinal axis of the elongated body itself.

In this way, the transversal bars 32 and the longitudinal reinforcing bars 33, 34 advantageously form a substantially ladder-shaped reinforcing framework, adapted to further stiffen the elongated body 3 made of expanded plastic material.

Thanks to the aforementioned structural features, furthermore, the hooking portions 30 define respective receiving zones wherein it is possible to fit the transversal bars 32 in a substantially bayonet-wise manner, so as to rigidly associate to one another the reinforcement metal structure 11 and the elongated body 3 made of expanded plastic material.

Advantageously, the diameter of the transversal bars 32 is slightly smaller than the height of the receiving zones defined by the hooking portions 30 extending from the lower side of the reinforcement metal structure 11.

This allows both a secure coupling between the reinforcement metal structure 11 and the elongated body 3, and easy coupling operations between the structure 11 and the body 3, which can be carried out both at the factory or at the building yard.

Preferably, the hooking portions 30 and the transversal bars 32 are pitchwise arranged along a direction substantially parallel to the longitudinal axis of the construction element 2 which coincides—as mentioned above—with the longitudinal axis of the elongated body 3.

Preferably, the pitch of the hooking portions and of the transversal bars is comprised between about 180 mm and about 220 mm.

In the preferred embodiment illustrated, moreover, the transversal bars 32 are provided on the upper side with longitudinal abutment elements 35, 36 arranged at opposite parts of the lower longitudinal rods 25, 26 of the reinforcement metal structure 11 and adapted to cooperate in abutment relationship with said rods.

Advantageously, the longitudinal abutment elements 35, 36 cooperate in abutment relationship with the rods 25, 26 so as to prevent that the reinforcement metal structure 11 thus defined may open under the load of the concrete casting 5 or as a consequence of other stresses directed perpendicularly to the metal structure itself.

In the preferred embodiment illustrated in FIG. 1, the reinforcement metal structure 11 of the casting 5 is provided with a supporting plate 37 at its free ends 12 protruding from the elongated body 3 made of expanded plastic material.

Advantageously, the plate 37 allows to lay in a stable and safe manner the composite construction element 2 on the supporting structures, for example walls or beams, of the building being erected and to close the reinforcement metal structure 11 at the ends, holding in place both the lower longitudinal rods 25, 26 and the upper longitudinal rod 27, which rods are fixed, for example by welding, to the plate 37 itself.

Advantageously, moreover, the plate 37 also acts as an element adapted to distribute the loads applied on the composite construction element 2 along a direction substantially perpendicular to the element itself.

Preferably, the free ends 12 of the reinforcement metal structure 11 and the plates 37 associated thereto, protrude from the elongated body 3 made of expanded plastic material at a predetermined distance from the lower face 14 of the aforementioned body.

Preferably, such a distance is comprised between about 40 and about 80 mm.

In this way, it is advantageously possible to adjust the heat and sound insulation characteristics of the composite construction element 2 by adjusting the thickness of the portion of the elongated body 3 extending below the longitudinal channel 4, and to have a composite construction element 2 which, once laid on a so-called whole-thickness truss beam, allows to obtain a covering extending perfectly flush with the entire lower face of the floor structure 1, as will better appear in the following description.

The composite construction element 2 illustrated hereinabove can be advantageously obtained by operations known in the art, for example by using known equipment for manufacturing the trestle 24 and known equipment for molding in a continuous or discontinuous manner the elongated body 3 made of expanded plastic material incorporating the bars 32-34.

From the preceding description, the features and the technical effects that can be achieved by the floor structure 1 and by the composite construction element 2 of the invention are immediately clear.

Since the composite construction element 2 incorporates both the load-bearing structure—the reinforcement metal structure 11 of the casting 5—and the structure for containing the casting—the elongated body 3 made of expanded plastic material provided with the longitudinal channel 4 open on the upper side—it is advantageously possible to minimize the operations required for assembling the floor structure 1 at the yard.

These operations, in fact, essentially provide for the steps of installing a plurality of composite construction elements 2, suitably spaced apart by the floor elements 6, on the load-bearing structures of the building being erected, and afterwards of casting the concrete on the elements 2 and 6.

Once the composite construction elements 2 have been laid, the load bearing characteristics are ensured by the reinforcement metal structure 11 on which the elongated bodies 3 made of expanded plastic materials are hanged without being laid on any of the load bearing structures of the building being erected, whereas the casting containment function is ensured by the longitudinal channel 4 and by the open zone defined above the same between the protruding portions 19, 20 of consecutive floor elements 6.

Advantageously, the aforementioned operating steps can be carried out without using temporary supports for lengths of the floor structure 1 up to about 3 meters or by using a very limited number of temporary supports for greater lengths.

Advantageously, moreover, the aforementioned installation step of the composite construction elements 2 can be rapidly carried out with a minimal labor, thanks to the compactness, lightness and handiness of the elements themselves.

FIGS. 2*b* to 13 schematically illustrate additional alternative embodiments of the composite construction element 2 and of the floor structure 1 according to the present invention. These additional embodiments achieve both the advantageous technical effects of the embodiment described hereinbefore and the additional technical effects detailed hereinafter.

In the following description and in such figures, the components of the composite construction element 2 and of the floor structure 1 structurally or functionally equivalent to those illustrated with reference to the previous embodiment will be indicated with the same reference numerals and will not be further described.

Figure 2B:
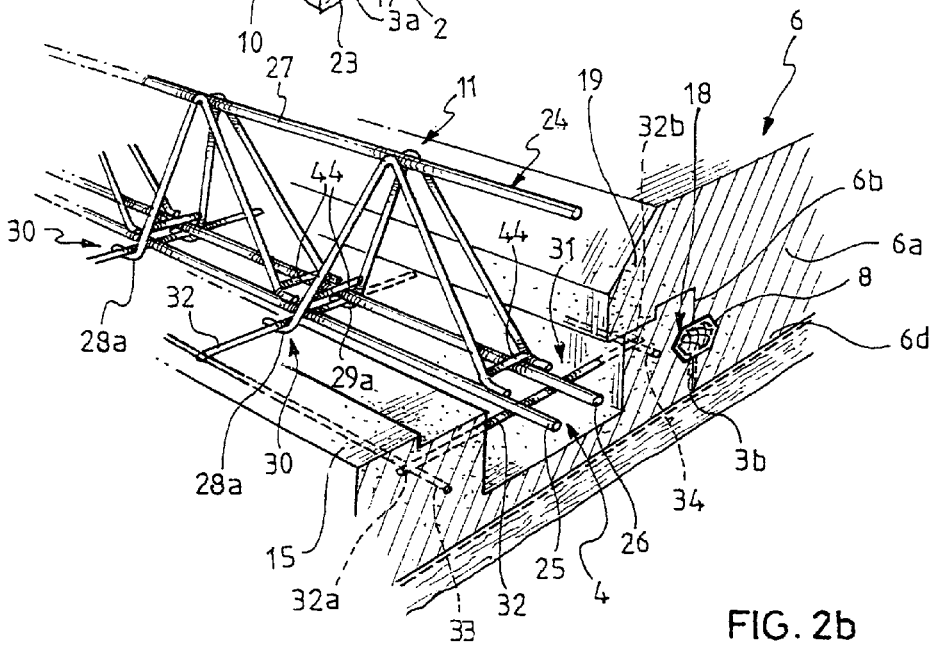
FIG. 2*b* shows a perspective view, in enlarged scale and in partial cross-section, of some details of a floor structure and of a composite construction element according to a second preferred embodiment of the invention.

According to a second embodiment of the invention, illustrated in FIG. 2*b*, the composite construction element 2 is a so-called joist element similar to the construction element illustrated in FIGS. 1 and 2*a* except for a different configuration of the reinforcement metal structure 11 and of the transversal bars 32.

In this case, the trestle-shaped reinforcement metal structure 11 is provided with a plurality of transversal stiffening elements 44, preferably metal rods, extending between the lateral stiffening rods 28, 29 which they are fixed to, for example by welding.

The transversal stiffening elements 44, which are preferably extending along a direction substantially perpendicular to the longitudinal axis of the reinforcement metal structure 11, constitute as many means adapted to prevent that the reinforcement metal structure 11, in this case consisting of the trestle 24, may open under the load of the concrete casting 5 or as a consequence of other stresses directed perpendicularly to the metal structure itself.

Figure 3A:
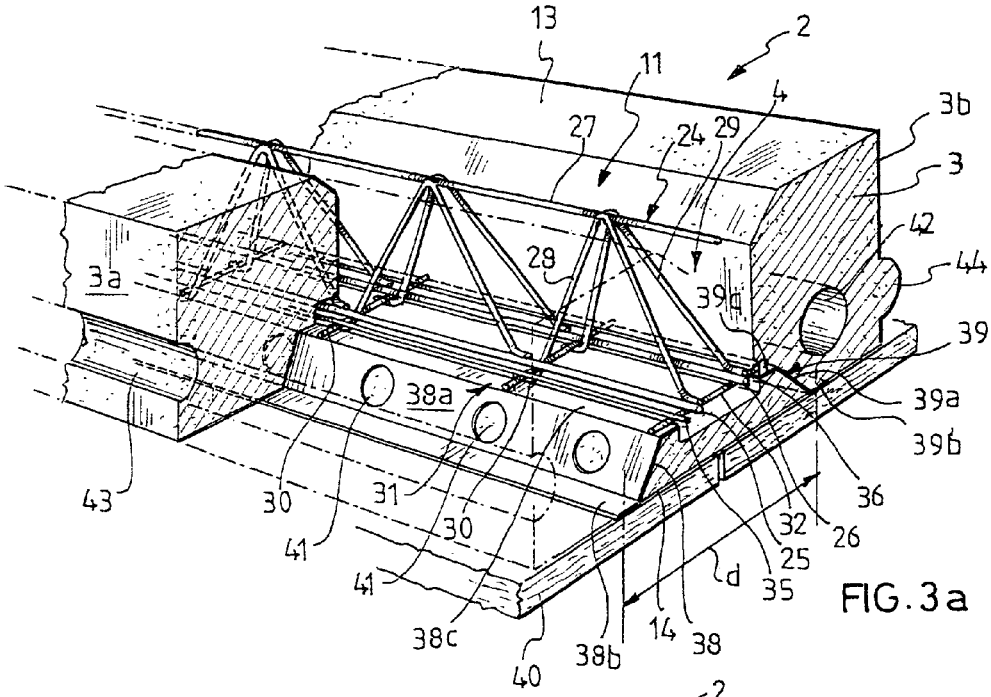
FIG. 3*a* shows a perspective view, in enlarged scale and in partial cross-section, of some details of a floor structure and of a composite construction element according to a third fourth preferred embodiment of the invention.

According to a third embodiment of the invention, illustrated in FIG. 3*a*, the composite construction element 2 is a so-called floor element usable in the construction of a floor structure 1 including a plurality of construction elements arranged in side by side relationship with one another preferably without interposition or use of other elements of conventional type.

In this case, the composite construction element 2 comprises an elongated body 3, substantially parallelepipedic, wherein a plurality of parallel recesses 42, of which only one is visible in FIG. 3*a*, is longitudinally defined.

The elongated body 3 is laterally provided in turn with opposite sides 3*a*, 3*b* respectively provided with a groove 43 and a rib 44, having a mating shape, longitudinally extending along the entire length of the elongated body 3.

In this way, a plurality of composite construction elements 2 mutually arranged side by side can be securely connected to one another with a substantially joint-wise coupling.

In the example illustrated in FIG. 3*a*, the composite construction element 2 further comprises at least one reinforcing section bar, preferably a plurality of reinforcing section bars 38, 39 associated to the elongated body 3 made of expanded plastic material.

Preferably, the reinforcing section bars 38, 39 are longitudinally extending in the elongated body 3 at opposite parts of the longitudinal channel 4, preferably in a symmetrical manner with respect to the longitudinal center plane Y-Y of the composite construction element 2 defining the longitudinal axis of the elongated body 3.

The reinforcing section bars 38, 39 are also longitudinally extending in the elongated body 3 along a direction substantially parallel to the aforementioned longitudinal axis.

Thanks to this arrangement of the reinforcing section bars 38, 39, it is advantageously possible to achieve even reinforcement characteristics of the elongated body 3 at opposite parts of the longitudinal channel 4.

Preferably, the reinforcing section bars 38, 39 are made of a material having suitable structural characteristics, for example cold-rolled and preferably galvanized steel, suitably shaped and having a thickness comprised between, for example, about 0.4 mm and about 0.8 mm.

In the preferred embodiment illustrated, the reinforcing section bars 38, 39 are substantially Z-shaped and can be obtained by conventional bending and shearing operations, known per se, starting from a metal sheet having suitable width and thickness.

As a consequence of these operations, the reinforcing section bars 38, 39 are provided with a central body 38*a*, 39*a* and with two lower 38*b*, 39*b* and, respectively, upper fins 38*c*, 39*c* extending from the opposite ends of the central body of the section bar.

In the preferred embodiment illustrated in FIG. 3*a*, the reinforcing section bars 38, 39 are arranged in the elongated body 3 at a predetermined distance from one another; preferably, the distance d between the center line of the lower fins 38*b*, 39*b*—measured along a direction substantially perpendicular to the longitudinal axis of the elongated body 3—is equal to about 300 mm.

Preferably, moreover, the reinforcing section bars are advantageously provided with a plurality of openings 41 formed in the central portion 38*a*, 39*a* thereof, comprised between the aforementioned fins 38*b*, 38*c* and 39*b*, 39*c*.

The openings 41 carry out the dual advantageous function of lightening the reinforcing section bars 38, 39 and of allowing an even more intimate integration thereof in the mass of expanded plastic material.

Thanks to the presence of the openings 41, in fact, the mass of expanded plastic material is capable of interpenetrating with the reinforcing section bars 38, 39 during the molding operation, integrating and securely holding the reinforcing section bars 38, 39 in position in the elongated body 3 of the composite construction element 2.

This intimate integration of the reinforcing section bars 38, 39 in the mass of expanded plastic material, moreover, prevents any deformation or bending along the transversal direction of the reinforcing section bars 38, 39 even though they are essentially constituted by a fairly thin metal sheet.

Preferably, the aforementioned openings have a total area comprised between about 10% and about 40% of the total area of the reinforcing section bar.

According to the invention, the shape of the openings—obtainable in any manner known per se, such as for example by punching—is not critical; in any case, it is preferably circular for obvious reasons of construction simplicity.

In this case, the openings have a diameter preferably comprised between about 15 mm and about 150 mm.

In a preferred embodiment, the openings are pitchwise arranged in the central portion of the reinforcing section bar along the longitudinal center plane of the section bar itself.

Preferably, the pitch of the opening is comprised between about 80 and about 100 mm.

In the preferred embodiment illustrated, the reinforcing section bars 38, 39 are advantageously provided with a lower portion—for example constituted by the lower fins 38*b*, 39*b*—extending flush with and substantially parallel to the lower face 14 of the elongated body 3.

The lower fins 38*b*, 39*b* carry out the function of providing a suitable supporting surface which a suitable rigid covering element, for example a plasterboard panel 40 fixed to the fins in a way known per se, for example by means of screws, can be fixed to or, in the alternative, which a suitable flexible covering-element, such as for example a stretched lath for supporting at least one covering layer (not shown in FIG. 3*a*), can be fixed to.

Preferably, the reinforcing section bars 38, 39 are longitudinally extending within the elongated body 3 along substantially the entire length thereof, and they are for example embedded in this body during the molding of the expanded plastic material.

In the preferred embodiment illustrated, the reinforcing section bars 38, 39 are advantageously securely associated to the reinforcement metal structure 11 of the concrete casting by means of the transversal bars 32 extending through the longitudinal channel 4.

To this end, the transversal bars 32 are fixed at their opposite ends to an upper portion—for example to the upper fins 38*c*, 39*c*—of the reinforcing section bars 38, 39.

In this way, the composite construction element 2 advantageously achieves improved fire resistance characteristics since the covering elements, the plasterboard panels 40 associated to the lower face 14 of the elongated body 3, are securely held by the reinforcement metal structure 11 embedded in the concrete casting 5 by means of the reinforcing section bars 38, 39.

In case of fire, therefore, the covering elements 40 do not detach from the composite construction element 2 even in the presence of a complete collapse of the elongated body 3 made of expanded plastic material.

This alternative embodiment of the composite construction element 2 of the invention achieves both the advantageous technical effects of the previous embodiment and the additional technical effects achieved thanks to the presence of the reinforcing section bars 38, 38 and thanks to the stable association thereof to the reinforcement metal structure 11, in terms of higher stability and load bearing capacity and of fire resistance.

Figure 3B:
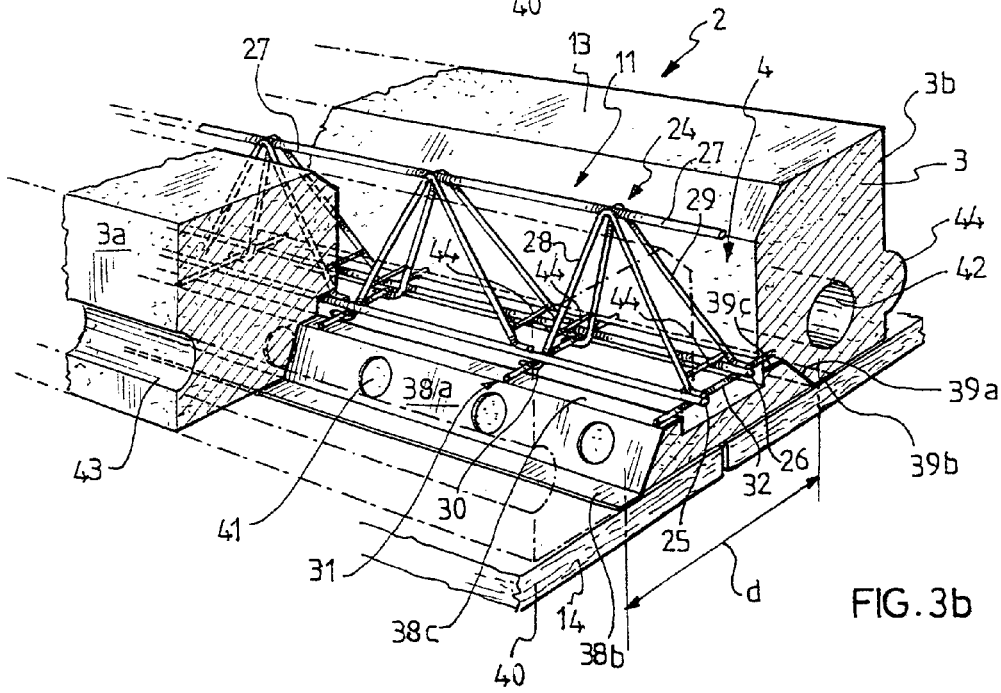
FIG. 3*b* shows a perspective view, in enlarged scale and in partial cross-section, of some details of a floor structure and of a composite construction element according to a fourth preferred embodiment of the invention.

According to a further embodiment of the invention, illustrated in FIG. 3*b*, the composite construction element 2 is a so-called floor element similar to the construction element illustrated in FIG. 3*a* except for a different configuration of the reinforcement metal structure 11 and of the transversal bars 32.

In this case, the trestle-shaped reinforcement metal structure 11 is provided with a plurality of transversal stiffening elements 44, preferably metal rods, similar to the rods 44 illustrated with reference to the preferred embodiment of FIG. 2*b*.

Also in this case, the technical effect of the transversal stiffening elements 44, preferably extending along a direction substantially perpendicular to the longitudinal axis of the reinforcement metal structure 11, is to prevent that the trestle 24 may open under the load of the casting 5 or as a consequence of other stresses directed perpendicularly to the trestle itself.

Figure 4:
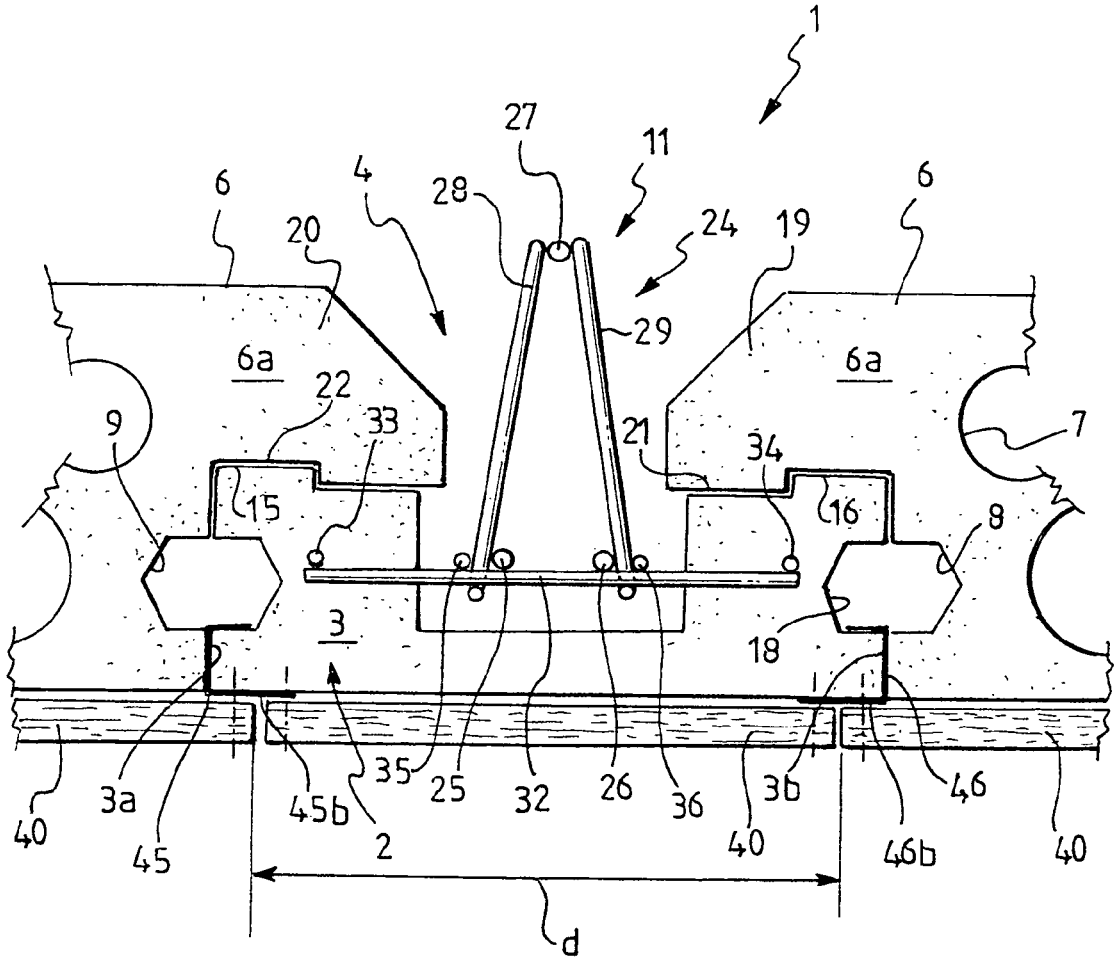
FIG. 4 shows a cross section view of some details of the first embodiment of the floor structure of FIG. 1 provided with a rigid covering element at the lower face thereof.

According to a further embodiment of the invention, illustrated in FIG. 4, the composite construction element 2 is a so-called joist element similar to the construction element illustrated in FIGS. 1 and 2*a* except for the presence of suitably shaped reinforcing section bars.

In this case, the composite construction element 2 comprises a pair of substantially C-shaped reinforcing section bars 45, 46 externally associated to a lower portion of the opposite sides 3*a*, 3*b* of the elongated body 3 made of expanded plastic material.

Preferably, the reinforcing section bars 45, 46 are longitudinally extending externally to the elongated body 3 along substantially its entire length.

Advantageously, the reinforcing section bars 45, 46 can be associated to the elongated body 3 made of expanded plastic material also after the molding operations of the latter, which in this case may be carried out with less complex and less expensive equipment.

Similarly to the embodiments of FIGS. 3*a* and 3*b*, the reinforcing section bars 45, 46 are provided with a lower portion, for example constituted by fins 45*b*, 46*b*, extending flush with and substantially parallel to the lower face 14 of the elongated body 3.

The fins 45*b*, 46*b* carry out the function of providing a suitable supporting surface which a suitable covering element can be fixed to, for example a plasterboard panel 40 or, if desired, a lath for supporting at least one layer made of a suitable covering material similarly to what has been illustrated with reference to FIGS. 1 and 2*a*.

Figure 5:
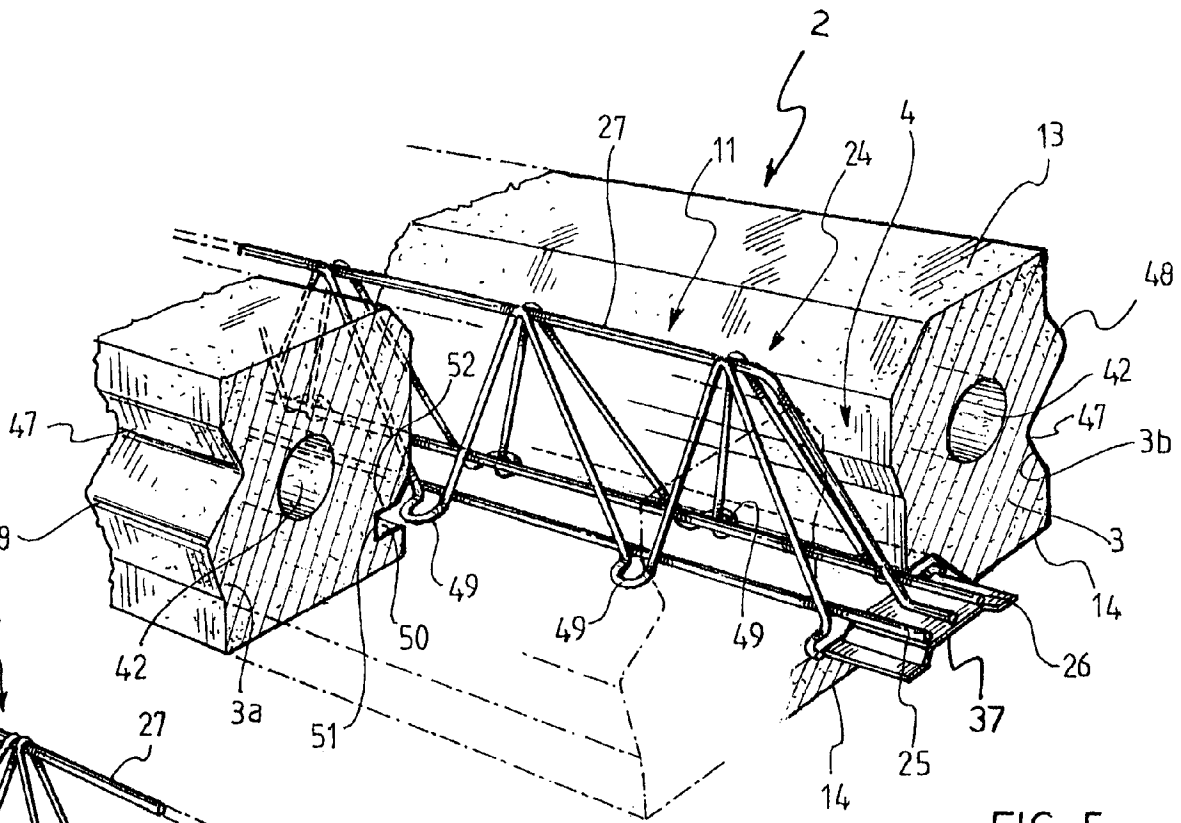
FIG. 5 shows a perspective view, in partial cross-section, of a composite construction element according to a fifth preferred embodiment of the invention.

In a further embodiment of the invention, illustrated in FIG. 5, the composite construction element 2 is a so-called floor element comprising a different configuration of the hooking means of the reinforcement metal structure 11 and of the engagement elements defined in the elongated body 3 intended to cooperate with them.

In this embodiment, the elongated body 3 of the composite construction element 2 is laterally provided with opposite sides 3*a*, 3*b* each provided with a groove 47 and with a rib 48, having a mating shape, longitudinally extending along the entire length of the elongated body 3.

In this way, a plurality of composite construction elements 2 arranged side by side can be securely connected to one another with a substantially joint-wise coupling.

In the preferred embodiment illustrated in FIG. 5, the hooking means of the reinforcement metal structure 11 comprises a plurality of hooking portions 49 laterally extending at opposite parts of the reinforcement metal structure 11.

Within the framework of this preferred embodiment, the engagement elements defined in the elongated body 3 made of expanded plastic material cooperating with the hooking means 49 comprise a pair of longitudinal grooves 50—only one of which is visible in FIG. 5—formed in the elongated body 3 at opposite parts of the longitudinal channel 4.

In this way, the elongated body 3 and the reinforcement metal structure 11 can be rigidly associated to each other by sliding drawer-wise one with respect to the other, for example by inserting the elongated body 3 onto the reinforcement metal structure 11 with a sliding movement guided by the engagement of the hooking portions 49 in the longitudinal grooves 50.

In this embodiment, the longitudinal grooves 50 define respective housing and sliding zones of the hooking portions 49 and are therefore preferably shaped so as to have a cross section substantially mating the cross section of the hooking portions 49 as illustrated in FIG. 5.

Preferably, the hooking portions 49 and the longitudinal grooves 50 are substantially perpendicular to the longitudinal center plane Y-Y of the composite construction element 2.

Preferably, the composite construction element 2 comprises in this case a suitably shaped and preferably slab-shaped reinforcing element 51 adapted to reinforce at least an upper wall 52 of the longitudinal grooves 50 and longitudinally extending in the elongated body 3 substantially parallel to said upper wall.

In this way, it is advantageously possible to prevent that the hooking portions 49 of the reinforcement metal structure 11 may damage the elongated body 3 made of expanded plastic material, when the latter is subjected to stresses directed perpendicularly to the body itself, such as for example vertical loads, or during the reciprocal sliding between the elongated body 3 and the reinforcement metal structure 11.

In the preferred embodiment illustrated in FIG. 5, the reinforcing element 51 is constituted by a section bar having substantially the same shape as the longitudinal grooves 50 and integrated in the mass of expanded plastic material along the entire periphery of the grooves themselves.

In this way, the reinforcing element 51 carries out the maximum protecting action of the inner walls of the longitudinal grooves 50 avoiding possible damages, whatever the direction of the stresses exerted by the hooking portions 49 may be.

In the preferred embodiment illustrated in FIG. 5, the reinforcement metal structure 11 is substantially constituted by a trestle 24 similar to that of the previous embodiments.

The lateral stiffening rods 28, 29 of trestle 24 are in this case provided with a plurality of portions substantially shaped as an upturned V and extending along a direction substantially parallel to the longitudinal axis X-X of the reinforcement metal structure 11.

The hooking portions 49 are therefore constituted by respective loop portions laterally extending in a cantilevered fashion from the trestle 24 between the aforementioned substantially V-shaped portions.

Figure 5A:
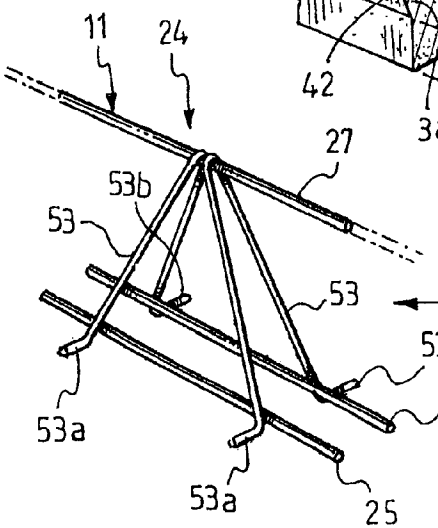
FIG. 5*a* shows a perspective view, in enlarged scale, of some details of the reinforcement metal structure of a composite construction element according to a sixth preferred embodiment of the invention.

According to a further embodiment of the invention, illustrated in FIG. 5*a*, the hooking portions 49 of the trestle 24 are constituted by respective end portions 53*a*, 53*b* of a plurality of stiffening staples 53 shaped as an upturned V arranged astride of the upper rod 27.

The aforementioned end portions 53*a*, 53*b* are laterally extending in a cantilevered fashion from the trestle 24 so as to achieve a technical effect similar to that of the loop portions of the lateral stiffening rods 28, 29 of the embodiment illustrated in FIG. 5.

Preferably, the stiffening staples 53 are structurally independent from one another and are fixed, for example by welding, to the upper longitudinal rod 27 of the reinforcement metal structure 11 at the vertex of the aforementioned V.

The stiffening staples 53 are also fixed, for example by welding, to the lower longitudinal rods 25, 26 at their end portions 53*a*, 53*b*.

Figure 6:
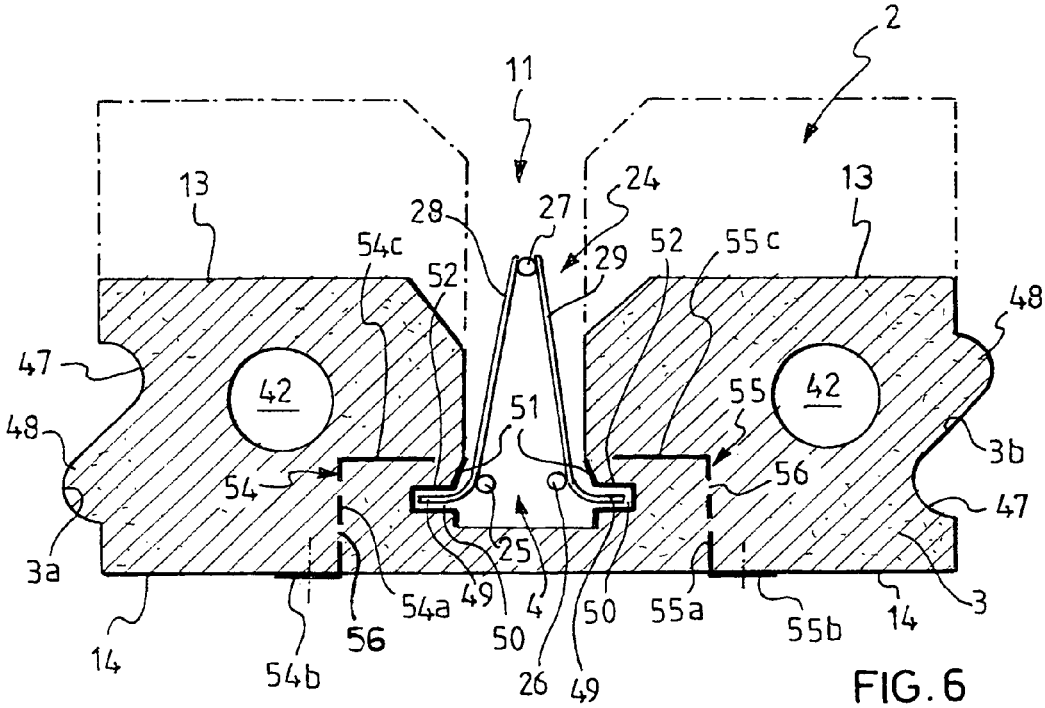
FIGS. 6-9 show as many cross-section views of a composite construction element according to seventh to tenth preferred embodiments of the invention.

According to a further embodiment of the invention, illustrated in FIG. 6, the composite construction element 2 is a so-called floor element similar to the construction element illustrated in FIG. 5 except for the fact that it further comprises at least one reinforcing section bar, preferably a plurality of reinforcing section bars 54, 55, associated to the elongated body 3 made of expanded plastic material.

Preferably, the reinforcing section bars 54, 55 are longitudinally extending in the elongated body 3 at opposite parts of the longitudinal channel 4, preferably symmetrically with respect to the longitudinal center plane Y-Y of the elongated body 3 along a direction substantially parallel to the longitudinal axis defined by such plane.

Similarly to the previous embodiments, also the reinforcing section bars 54, 55 are made of a material having suitable structural characteristics, for example cold-rolled and preferably galvanized steel, shaped in a suitable manner.

In the preferred embodiment illustrated, the reinforcing section bars 54, 55 are substantially Z-shaped and can be obtained by conventional bending and shearing operations, known per se, starting from a metal sheet having suitable width and thickness.

The reinforcing section bars 54, 55 are provided with a central body 54*a*, 55*a* and with two lower 54*b*, 55*b* and, respectively, upper fins 54*c*, 55*c* extending from opposite ends of the central body of the section bar.

Preferably, moreover, the reinforcing section bars 54, 55 are advantageously provided with a plurality of openings 56 formed in the central portion 54*a*, 55*a* thereof.

Also in this case, the shape of the openings is not critical; in any case, it is preferably circular for obvious reasons of construction simplicity.

In the preferred embodiment illustrated in FIG. 6, the reinforcing section bars 54, 55 are advantageously provided with a lower portion—for example constituted by the lower fins 54*b*, 55*b*—extending flush with and substantially parallel to the lower face 14 of the elongated body 3. Such fins carry out the function of providing a suitable supporting surface which a suitable covering element, such as for example a lath for supporting at least one layer made of a suitable covering material or a rigid covering element, such as for example a plasterboard panel, can be fixed to.

Preferably, the reinforcing section bars 54, 55 are longitudinally extending in the elongated body 3 along substantially the entire length thereof, and they are for example embedded in this body during the molding of the expanded plastic material.

From what has been described above, it is evident that the composite construction element 2 of this embodiment substantially achieves the same technical effects as the composite construction elements of FIGS. 3*a*, 3*b* and 4.

Figure 7:
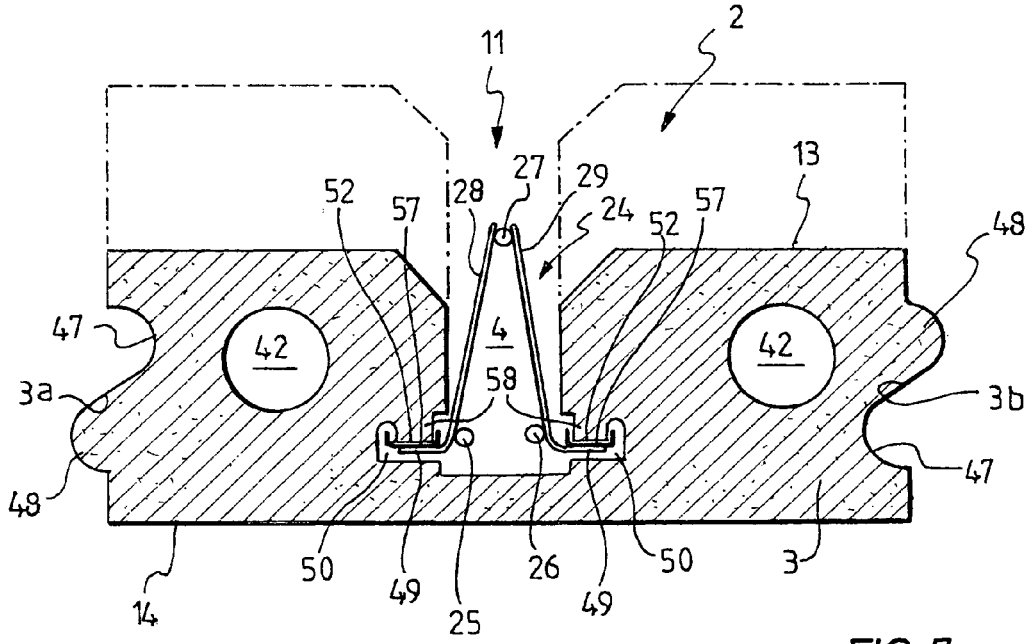

According to a further embodiment of the invention, illustrated in FIG. 7, the composite construction element 2 is a so-called floor element similar to the construction element illustrated in FIG. 5 except for a slightly different configuration of the hooking portions 49 laterally extending from the reinforcement metal structure 11, and of the longitudinal grooves 50 adapted to cooperate therewith.

In this preferred embodiment, the composite construction element 2 comprises a pair of supporting section bars 57 fixed on the upper side of the hooking portions 49 of the reinforcement metal structure 11 and cooperating in abutment relationship with the upper wall 52 of the longitudinal grooves 50 formed in the elongated body 3 made of expanded plastic material.

Preferably, the supporting section bars 57 have a substantially U shaped cross-section.

In this case, the upper wall 52 of the longitudinal grooves 50 and the supporting section bars 57 preferably have a substantially mating shape so as to minimize any possible reciprocal movements during the installation operations.

To this end, the upper wall 52 of the longitudinal grooves 50 can be provided with a rib 58 having a mating shape adapted to cooperate with the supporting section bars 57.

Figure 8:
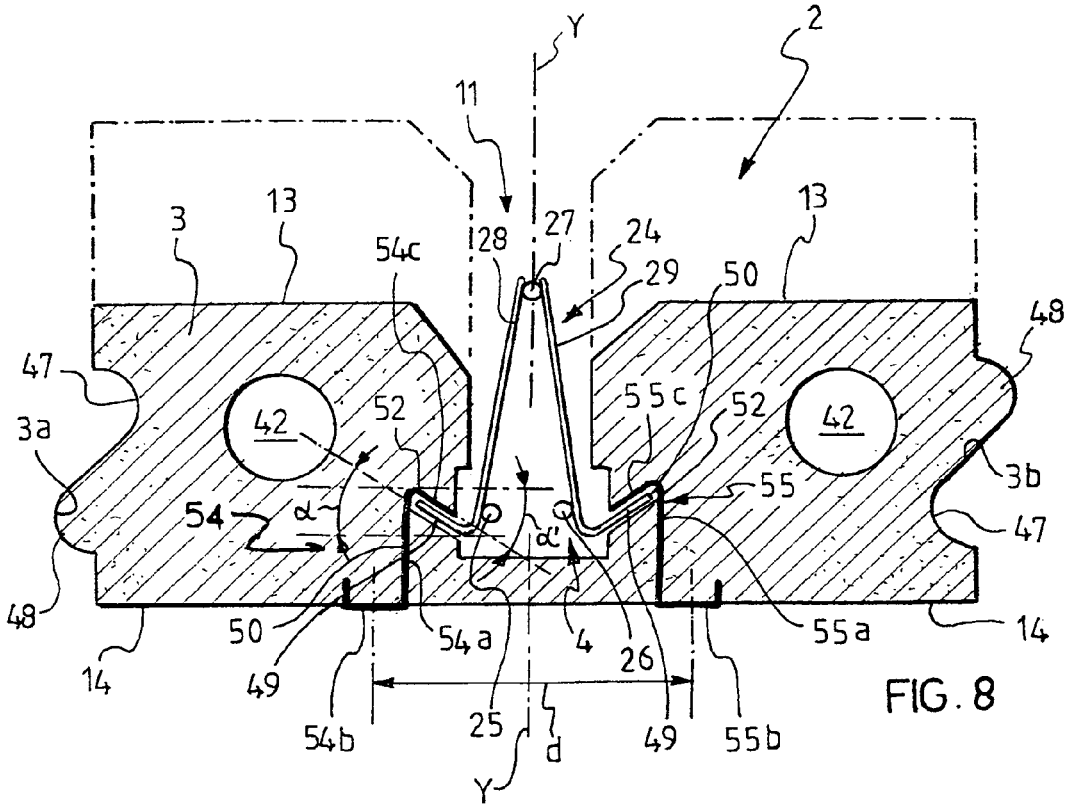

According to a further embodiment of the invention, illustrated in FIG. 8, the composite construction element 2 is a so-called floor element similar to the construction element illustrated in FIG. 6 except for a slightly different configuration of the hooking portions 49 laterally extending from the reinforcement metal structure 11, of the longitudinal grooves 50 adapted to cooperate therewith and of the reinforcing section bars 54 and 55.

In this case, the hooking portions 49 are inclined upwards and preferably form an angle $\alpha$ comprised between about 5° and about 15° with respect to a plane perpendicular to the longitudinal center plane Y-Y of the composite construction element 2, instead of being substantially perpendicular to the longitudinal center plane Y-Y of the composite construction element 2 as in the embodiments of FIGS. 5-7.

Correspondingly, the longitudinal grooves 50 adapted to cooperate with the hooking portions 49 are formed in the elongated body 3 so as to have a similar inclination with respect to the longitudinal center plane Y-Y of the composite construction element 2.

Advantageously, this configuration of parts allows to accomplish an improved resistance of the composite construction element 2 to a decentralized load due to an increased bending resistance achieved thanks to the supporting action exerted by the inclined hooking portions 49.

Also in this case, the reinforcing section bars 54 and 55 are provided with a central body 54*a*, 55*a* and with two lower 54*b*, 55*b* and, respectively, upper fins 54*c*, 55*c* extending from the opposite ends of the central body of the section bar.

The upper fins 54*c*, 55*c*, however, exhibit the peculiarity of extending flush with and substantially parallel to the upper wall 52 of the longitudinal grooves 50 formed in the elongated body 3 made of expanded plastic material, so as to form as many slab-shaped reinforcing elements of the wall 52 adapted to prevent damages thereof when the construction element 2 is stressed along the perpendicular direction (for example vertical).

In this case, therefore, the upper fins 54*c*, 55*c* preferably form an angle $\alpha'$ comprised between about 5° and about 15° with respect to a plane perpendicular to the longitudinal center plane Y-Y of the composite construction element 2.

In the preferred embodiment illustrated in FIG. 8, the lower fins 54*b* and 55*b* of the reinforcing section bars 54 and 55 are provided with an initial portion extending flush with and substantially parallel to the lower face 14 of the elongated body 3 and with an end portion substantially perpendicular to the aforementioned initial portion.

Advantageously, such initial portion carries out the function of providing a suitable supporting surface which a covering element, for example a lath for supporting at least one layer made of a suitable covering material or a rigid panel, can be fixed to, whereas the end portion increases the reinforcing action carried out by the reinforcing section bars 54 and 55 under bending loads.

Figure 9:
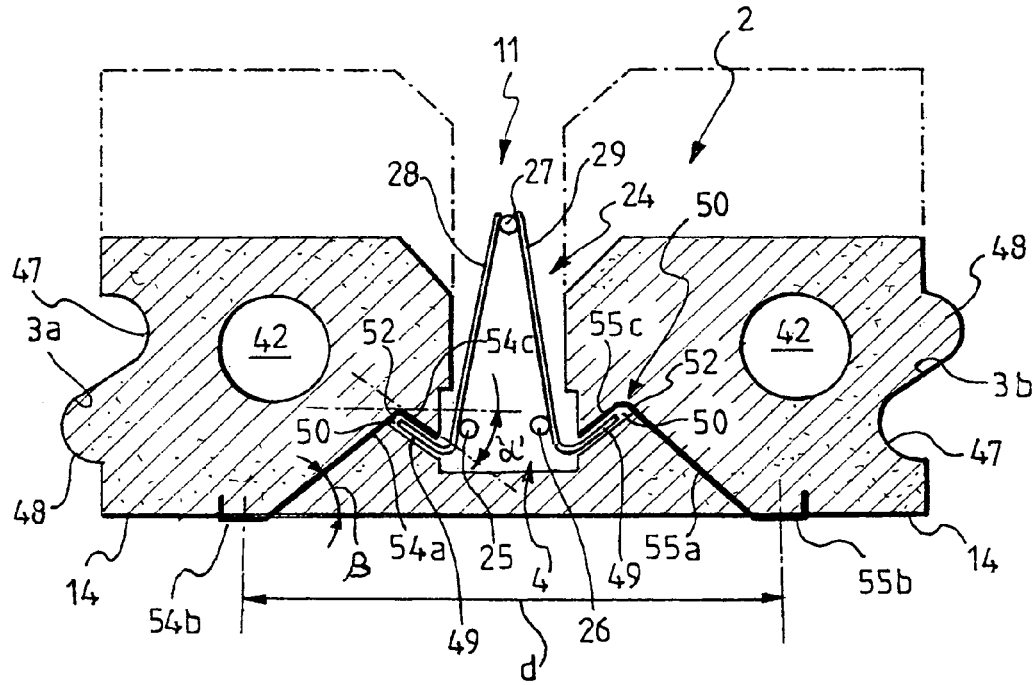

According to a further embodiment of the invention, illustrated in FIG. 9, the composite construction element 2 is a so-called floor element similar to the construction element illustrated in FIG. 8 except for a slightly different configuration of the reinforcing section bars 54 and 55.

In this case, the reinforcing section bars are provided with upper fins 54*c*, 55*c* forming an angle of predetermined value with respect to a plane perpendicular to the longitudinal center plane Y-Y of the composite construction element 2.

Preferably, such an angle has the same value as the angle $\alpha'$ and is comprised between about 5° and about 15° with respect to a plane perpendicular to the longitudinal center plane Y-Y of the composite construction element 2.

The central body 54°, 55° of the reinforcing section bars 54 and 55, moreover, forms an angle $\beta$ comprised between about 30° and about 45° with respect to a plane perpendicular to the longitudinal center plane Y-Y of the composite construction element 2.

In this way, it is advantageously possible to adjust the position of the lower fins 54*b*, 55*b* of the reinforcing section bars 54 and 55 along the transversal direction so as to have a distance predetermined in advance between the center line of such fins and simplify the fixing operations of the covering elements to the lower face 14 of the elongated body 3.

Figure 10:
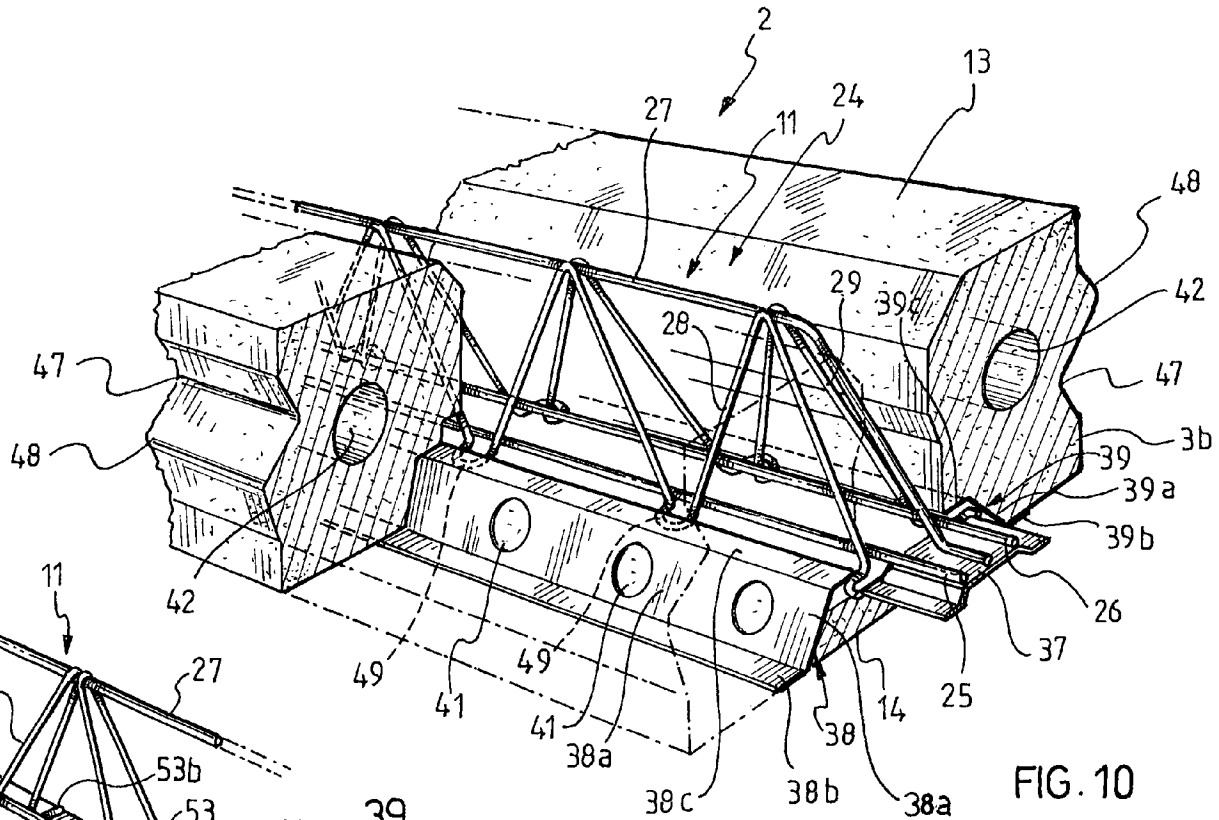
FIG. 10 shows a perspective view, in partial cross-section, of a composite construction element according to a eleventh preferred embodiment of the invention.

According to a further embodiment of the invention, illustrated in FIG. 10, the composite construction element 2 is a so-called floor element similar to the construction element illustrated in FIG. 5 except for the fact that it further comprises at least one reinforcing section bar, preferably a plurality of reinforcing section bars 38, 39 associated to the elongated body 3 made of expanded plastic material.

Preferably, the reinforcing section bars 38, 39 are similar to and substantially achieve the same technical effects of the reinforcing section bars illustrated with reference to the embodiments of FIGS. 3*a* and 3*b*.

Also in this case, therefore, the lower fins 38*b*, 39*b* of the reinforcing section bars 38, 39 carry out the advantageous function of providing a suitable supporting surface which a suitable rigid covering element, such as for example a panel of a rigid material, or alternatively a suitable flexible covering element, such as for example a stretched lath for supporting at least one covering layer (not shown in FIG. 10), can be fixed to.

In the preferred embodiment illustrated in FIG. 10, moreover, the reinforcing section bars 38, 39 are advantageously securely associated to the reinforcement metal structure 11 of the concrete casting by means of the hooking portions 49 laterally extending in a cantilevered fashion from the trestle 24.

To this end, the upper fins 38*c*, 39*c* of the reinforcing section bars 38, 39 are fixed to the hooking portions 49, for example by welding.

In this way, the composite construction element 2 advantageously achieves improved fire resistance characteristics since the covering elements associated to the lower face 14 of the elongated body 3, are securely held by the reinforcement metal structure 11 embedded in the concrete casting 5 by means of the reinforcing section bars 38, 39.

Preferably, the composite construction element 2 is manufactured by means of continuous operations by first manufacturing a reinforcement metal structure 11 provided with the reinforcing section bars 38, 39 and then by integrating the latter in the mass of expanded plastic material which constitutes the elongated body 3 during the molding step thereof.

Figure 10A:
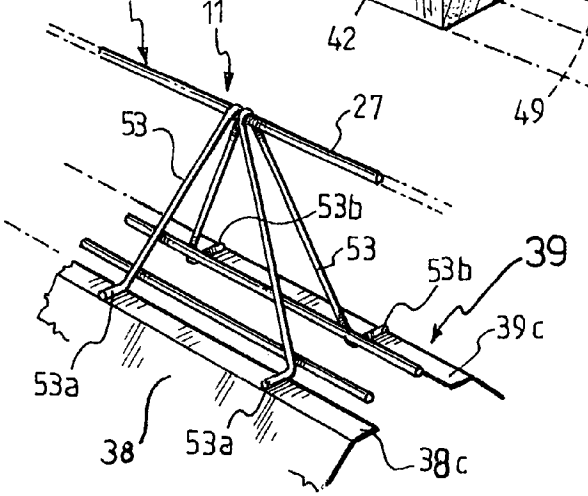
FIG. 10*a* shows a perspective view, in enlarged scale, of some details of the reinforcement metal structure of a composite construction element according to a twelfth preferred embodiment of the invention.

According to a further embodiment of the invention, illustrated in FIG. 10*a*, the hooking portions 49 of the trestle 24 are constituted by respective end portions 53*a*, 53*b* of a plurality of stiffening staples 53 shaped as an upturned V arranged astride of the upper rod 27.

The stiffening staples 53 are similar and substantially achieve the same technical effects of the staples illustrated with reference to the embodiment of the reinforcing metal structure 11 of FIG. 5*a*.

In this case, however, the reinforcement metal structure 11 comprises the reinforcing section bars 38, 39 securely associated thereto by means of the end portions 53*a*, 53*b* of the stiffening staples 53.

Figure 11:
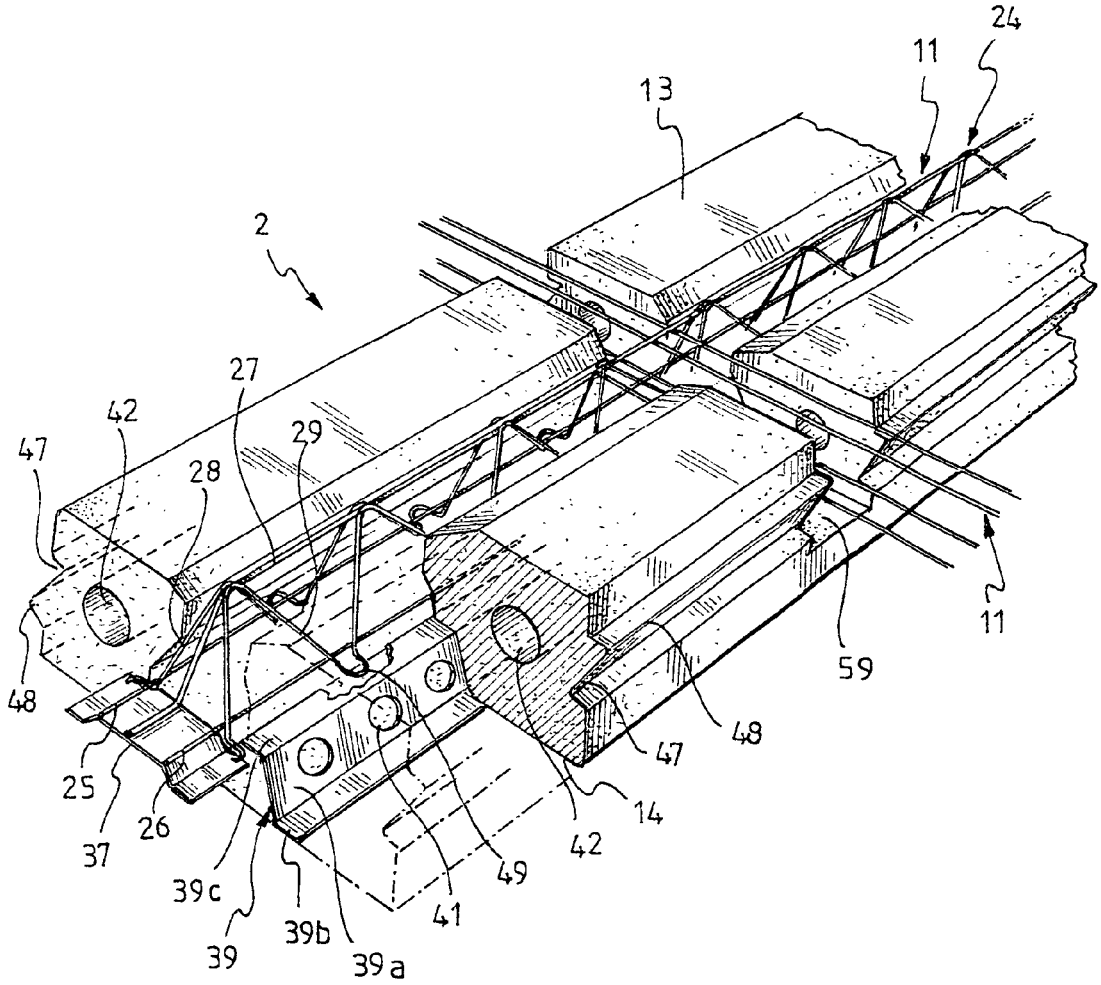
FIG. 11 shows a perspective view, in partial cross-section, of a composite construction element according to a thirteenth preferred embodiment of the invention.

According to a further embodiment of the invention, illustrated in FIG. 11, the composite construction element 2 is a so-called floor element similar to that illustrated in FIG. 10, from which it differs for the presence of at least one transversal channel 59, preferably a plurality of transversal channels 59 suitably spaced from one another in the longitudinal direction, formed in the elongated body 3 made of expanded plastic material and open on the upper side for housing the concrete casting 5.

The composite construction element 2 further comprises an additional reinforcement metal structure 11' of the casting, preferably a plurality of reinforcement metal structures 11', housed in the aforementioned transversal channels.

Advantageously, this composite construction element 2 allows to increase the load bearing characteristics of the floor structure 1 or to reduce the overall thickness of the floor structure 1 if the load bearing characteristics are maintained unaltered.

Figure 12:
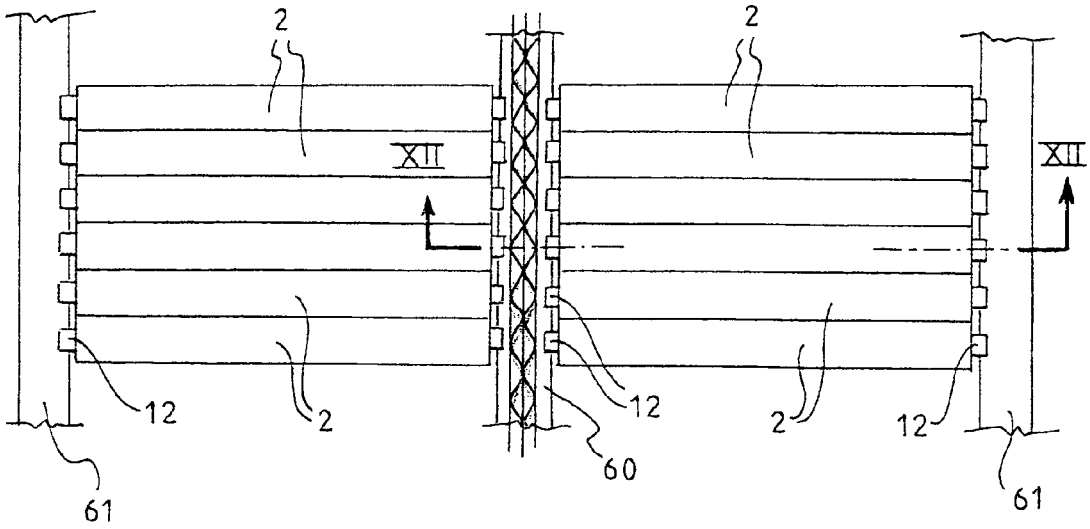
FIG. 12 shows a top view of a floor structure incorporating a plurality of composite construction elements according to a fourteenth embodiment of the invention.
Figure 13:
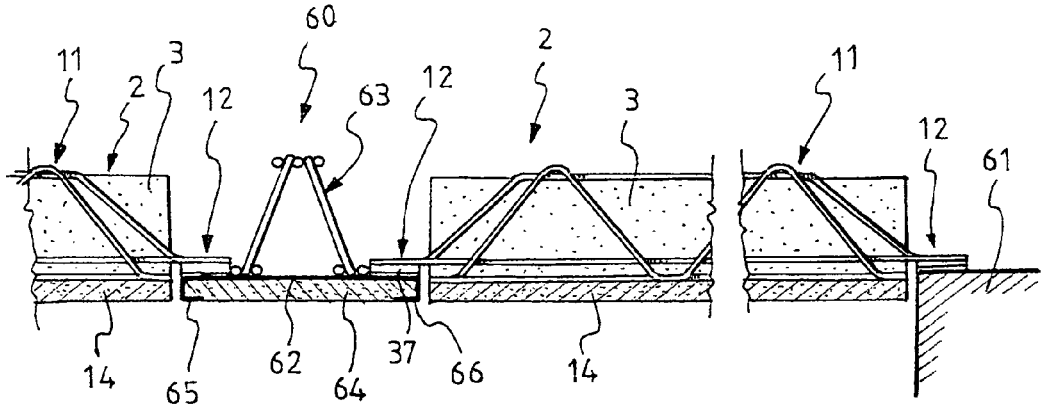
FIG. 13 shows a perspective view, in partial cross-section according to line XII-XII of FIG. 12, of some details of the floor structure and of one of the composite construction elements shown in such figure.

With reference to FIGS. 12 and 13, a further preferred embodiment of the floor structure I of the invention, especially suitable for manufacturing the so-called "wide span" floors, will now be described.

The floor structure 1 comprises a plurality of composite construction elements 2, in this case forming as many floor elements as illustrated, for example, in FIGS. 3*a*, 3*b*, and 5-10, laid at their opposite ends 12 on respective supporting structures of a building and arranged in side by side relationship with respect to one another.

These supporting structures can for example be constituted by a beam 60 and of load bearing walls 61 of the building being erected.

Preferably, the beam 60 is a so-called "whole-thickness truss beam", that is, has a thickness substantially equal to the thickness of the floor structure 1 and comprises a base 62, for example constituted by a metal or cement slab, and a supporting and reinforcing metal structure 63.

In the preferred embodiment illustrated, the metal structure. 63 is substantially constituted by a reticular trestle known per se.

Preferably, the beam 60 is further provided at a lower side with a covering slab 64 made of expanded plastic material fixed to the base 62 by means of two substantially C-shaped section bars 65, 66.

Advantageously, the thickness of the covering slab 64 is substantially equal to the distance between the free ends 12 of the reinforcement metal structures 11 and the lower face 14 of the elongated body 3 made of expanded plastic material of the composite construction elements 2.

In this way, it is advantageously possible to have a covering extending flush with the lower face of the floor structure 1, beams included, also for very wide spans, for example of more than about 6 meters.

As illustrated in FIG. 13, the lower face 14 of the elongated body 3 made of expanded plastic material in fact lies in a plane which is located below the lower face of the bare whole-thickness truss beam, that is, without the covering slab 64.

Advantageously, moreover, the thickness of the covering made of expanded plastic material of the lower face of the floor structure 1 can be adjusted as desired by simply adjusting the thickness of the portion of the elongated body 3 made of plastic material extending below the longitudinal channel 4 wherein the reinforcement metal structure 11 is housed and the thickness of the covering slab 64.

Clearly, a man skilled in the art may introduce modifications and variants to the invention described hereinbefore in order to meet specific and contingent application requirements, variants and modifications which anyway fall within the scope of protection as defined in the attached claims.

What is claimed is:

1. Composite construction element for manufacturing building floors comprising:

an elongated body made of expanded plastic material, provided with at least one longitudinal channel open on an upper side for receiving a concrete casting;

a reinforcement metal structure of the casting to be housed in said at least one longitudinal channel;

wherein the reinforcement metal structure is provided with:

a plurality of engagement elements at least in part rigidly incorporated within said elongated body at the time of its manufacturing and at least partially extending in said at least one longitudinal channel, and a separate trestle provided with hooking means adapted to engage with said engagement elements for rigidly associating with one another said trestle and said elongated body, after manufacturing of the same and prior to pouring of the casting into said at least one longitudinal channel, wherein said trestle has opposite free ends protruding from longitudinally opposite sides of said longitudinal channel.

2. Composite construction element according to claim 1, wherein said hooking means comprises a plurality of hooking portions extending from a lower side of the reinforcement metal structure.

3. Composite construction element according to claim 2, wherein said hooking portions are provided with a portion extending substantially parallel to the longitudinal axis of the reinforcement metal structure.

4. Composite construction element according to claim 1, wherein said engagement elements comprise a plurality of transversal bars having opposite ends and a central portion extending through said at least one longitudinal channel along a direction substantially perpendicular to the longitudinal axis of the elongated body, said opposite ends being embedded within said elongated body at opposite sides of said at least one longitudinal channel.

5. Composite construction element according to claim 4, wherein said transversal bars are provided with opposite ends fixed to respective reinforcing bars longitudinally extending in the elongated body at opposite parts of said at least one longitudinal channel along a direction substantially parallel to the longitudinal axis of said body.

6. Composite construction element according to claim 4, wherein the hooking portions, extending from the lower side of the trestle, and the transversal bars, extending through said longitudinal channel for rigidly associating with one another said reinforcement metal structure and said elongated body, are pitchwise arranged along a direction substantially parallel to the longitudinal axis of the construction element.

7. Composite construction element according to claim 1, wherein said trestle comprises a pair of lower longitudinal rods connected to at least one upper longitudinal rod by a plurality of lateral stiffening elements.

8. Composite construction element according to claim 7, wherein the lateral stiffening elements are metal rods substantially shaped as an upturned V and arranged in pairs along a direction substantially parallel to the longitudinal axis of said trestle.

9. Composite construction element according to claim 8, wherein the lateral stiffening rods are provided with a free end extending from the lower side of said trestle and defining said hooking portion.

10. Composite construction element according to claim 7, wherein the transversal bars integral with the elongated body are provided on the upper side with longitudinal abutment elements arranged at opposite parts of said pair of lower longitudinal rods of said trestle and adapted to cooperate in abutment relationship with said rods.

11. Composite construction element according to claim 7, wherein said trestle comprises a plurality of transversal stiffening elements fixed to said lateral stiffening elements and extending therebetween.

12. Composite construction element according to claim 7, wherein the lateral stiffening elements are metal rods provided with a plurality of portions substantially shaped as an upturned V extending along a direction substantially parallel to the longitudinal axis of the said trestle.

13. Composite construction element according to claim 1, wherein said hooking means comprises a plurality of hooking portions laterally extending at opposite parts of said trestle.

14. Composite construction element according to claim 13, wherein said engagement elements comprise a pair of longitudinal grooves extending in said at least one longitudinal channel at opposite parts thereof, along a direction substantially parallel to the longitudinal axis of said elongated body.

15. Composite construction element according to claim 14, further comprising a slab-shaped reinforcing element adapted to reinforce at least an upper wall of the longitudinal grooves and longitudinally extending in the elongated body made of expanded plastic material substantially parallel to said upper wall.

16. Composite construction element according to claim 15, wherein said reinforcing section bars are provided with an upper fin extending flush with and substantially parallel to the upper wall of the longitudinal grooves formed in the elongated body made of expanded plastic material, said fin forming said slab-shaped reinforcing element of the wall.

17. Composite construction element according to claim 13, further comprising a pair of supporting section bars fixed on the upper side of said hooking portions of said trestle and cooperating in abutment relationship with an upper wall of the longitudinal grooves formed in the elongated body made of expanded plastic material.

18. Composite construction element according to claim 13, wherein said hooking portions of said trestle are constituted by respective loop portions extending in a cantilevered fashion from the trestle between said substantially V-shaped portions.

19. Composite construction element according to claim 13, wherein said hooking portions of said trestle are constituted by respective end portions of stiffening staples laterally extending in a cantilevered fashion from the trestle.

20. Composite construction element according to claim 13, wherein said at least one reinforcing section bar is associated to the hooking portions laterally extending at opposite parts of said trestle.

21. Composite construction element according to claim 1, further comprising at least one reinforcing section bar associated to the elongated body made of expanded plastic material and having a lower portion extending substantially parallel to a lower face of said elongated body.

22. Composite construction element according to claim 21, wherein said at least one reinforcing section bar is securely associated to said trestle.

23. Composite construction element according to claim 21, wherein said lower portion of said at least one reinforcing section bar extends flush with said lower face of the elongated body made of expanded plastic material.

24. Composite construction element according to claim 21, wherein said lower portion of said at least one reinforcing section bar is completely incorporated in the mass of expanded plastic material and is arranged at a predetermined distance from the lower face of the elongated body.

25. Composite construction element according to claim 21, comprising a pair of reinforcing section bars longitudinally extending in the elongated body at opposite parts of said at least one longitudinal channel along a direction substantially parallel to the longitudinal axis of said elongated body.

26. Composite construction element according to claim 25, wherein said reinforcing section bars are substantially C shaped and are externally associated to a lower portion of opposite sides of the elongated body made of expanded plastic material.

27. Composite construction element according to claim 21, wherein said at least one reinforcing section bar is provided with a plurality of openings formed in a central portion thereof.

28. Composite construction element according to claim 21, wherein the transversal bars extending through the longitudinal channel formed in the elongated body made of expanded plastic material are provided with opposite ends fixed to an upper portion of said at least one reinforcing section bar.

29. Composite construction element according to claim 21, wherein said lath is associated to said lower portion of said at least one reinforcing section bar.

30. Composite construction element according to claim 21, wherein a rigid covering element is associated to said lower portion of said at least one reinforcing section bar.

31. Composite construction element according to claim 1, further comprising a lath for supporting at least one layer made of a suitable covering material associated to a lower face of the elongated body made of expanded plastic material.

32. Composite construction element according to claim 31, wherein said lath comprises opposite lateral portions housed in respective longitudinal housing seats formed in opposite sides of the elongated body made of expanded plastic material.

33. Composite construction element according to claim 31, wherein said covering material is plaster or cement optionally incorporating reinforcing fibers of a suitable material.

34. Composite construction element according to claim 1, further comprising a rigid covering element associated to a lower face of the elongated body made of expanded plastic material.

35. Composite construction element according to claim 34, wherein said rigid covering element is a panel of plasterboard, wood, rigid plastic material or other suitable material.

36. Composite construction element according to claim 1, further comprising at least one transversal channel formed in the elongated body made of expanded plastic material and open on the upper side for receiving a concrete casting and an additional reinforcement metal structure of the casting housed in said at least one transversal channel.

37. Composite construction element according to claim 1, wherein said trestle is provided with a supporting plate at its free ends protruding from the elongated body made of expanded plastic material.

38. Composite construction element according to claim 1, wherein the free ends of said trestle protrude from the elongated body made of expanded plastic material at a predetermined distance from a lower face of said body.

39. Floor structure comprising a plurality of composite construction elements according to claim 1 laid at their opposite ends on respective supporting structures of a building.

40. Floor structure according to claim 39, wherein the composite construction elements are arranged in side by side relationship.

41. Floor structure according to claim 39, further comprising construction elements made of expanded plastic material arranged between consecutive composite construction elements.

42. Floor structure according to claim 39, wherein at least one of said supporting structures is a beam having a thickness equal to the thickness of the floor structure.

43. Floor structure according to claim 42, wherein said beam is provided at a lower side with a covering slab made of expanded plastic material.

44. Floor structure according to claim 43, wherein the thickness of said covering slab of the beam is substantially equal to the distance between the free ends of the reinforcement metal structures and the lower face of the elongated body made of expanded plastic material of the composite construction elements.

* * * * *